US011094228B2

(12) United States Patent
Miyajima

(10) Patent No.: US 11,094,228 B2
(45) Date of Patent: Aug. 17, 2021

(54) INFORMATION PROCESSING DEVICE, INFORMATION PROCESSING METHOD, AND RECORDING MEDIUM

(71) Applicant: SONY CORPORATION, Tokyo (JP)

(72) Inventor: Yasushi Miyajima, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 16/330,637

(22) PCT Filed: Aug. 10, 2017

(86) PCT No.: PCT/JP2017/029099

§ 371 (c)(1),
(2) Date: Mar. 5, 2019

(87) PCT Pub. No.: WO2018/087972

PCT Pub. Date: May 17, 2018

(65) Prior Publication Data

US 2020/0226959 A1 Jul. 16, 2020

(30) Foreign Application Priority Data

Nov. 14, 2016 (JP) ..... JP2016-221658

(51) Int. Cl.
*G09F 9/30* (2006.01)
*G09F 19/22* (2006.01)
(Continued)

(52) U.S. Cl.
CPC ..... *G09F 9/3026* (2013.01); *G09F 19/22* (2013.01); *G09F 23/0058* (2013.01);
(Continued)

(58) Field of Classification Search
CPC combination set(s) only.
See application file for complete search history.

(56) References Cited

U.S. PATENT DOCUMENTS 5,771,617 A 6/1998 Baker
9,195,320 B1 11/2015 Lee et al.
(Continued)

FOREIGN PATENT DOCUMENTS

CN 103201710 A 7/2013
CN 105698469 A 6/2016
(Continued)

OTHER PUBLICATIONS

International Search Report dated Sep. 19, 2017 in PCT/JP2017/029099 filed Aug. 10, 2017.
(Continued)

*Primary Examiner* — Wesner Sajous
(74) *Attorney, Agent, or Firm* — Oblon, McClelland, Maier & Neustadt, L.L.P.

(57) ABSTRACT

To provide an information processing device, an information processing method, and a recording medium capable of appropriately presenting necessary information while maintaining scenery.

An information processing device including: a communication unit configured to receive sensor data detected by a sensor for grasping a surrounding situation; and a control unit configured to perform control to generate a control signal for displaying an image including appropriate information on a display unit installed around the sensor, in accordance with at least one of an attribute of a user, a situation of the user, or an environment detected from the sensor data, generate a control signal for displaying a blending image that blends into surroundings of the display unit on the display unit in a case where information presentation is determined to be unnecessary, and transmit the control signal to the display unit via the communication unit.

10 Claims, 22 Drawing Sheets

(51) Int. Cl.
*G09F 23/00* (2006.01)
*G09F 27/00* (2006.01)
*G09F 9/302* (2006.01)

(52) U.S. Cl.
CPC ..... *G09F 27/00* (2013.01); *G09F 27/005* (2013.01); *G09F 2027/001* (2013.01)

(56) References Cited

U.S. PATENT DOCUMENTS

| | | | | |
|---|---|---|---|---|
| 2012/0139956 | A1 | 6/2012 | Joseph et al. | |
| 2013/0127980 | A1* | 5/2013 | Haddick | G02B 27/0093 348/14.08 |
| 2013/0241821 | A1 | 9/2013 | Hiyama et al. | |
| 2014/0300265 | A1 | 10/2014 | Lee et al. | |
| 2015/0283763 | A1* | 10/2015 | Chi | B29C 64/386 700/119 |
| 2016/0169576 | A1 | 6/2016 | Takaki et al. | |
| 2016/0260261 | A1* | 9/2016 | Hsu | B23K 9/32 |
| 2019/0015033 | A1* | 1/2019 | Sahin | A61B 5/6803 |
| 2019/0361694 | A1* | 11/2019 | Gordon | G06F 1/3231 |

FOREIGN PATENT DOCUMENTS

| | | | |
|---|---|---|---|
| EP | 2 461 318 | A2 | 6/2012 |
| JP | 2002-73321 | A | 3/2002 |
| JP | 2002-81818 | A | 3/2002 |
| JP | 2003-271084 | A | 9/2003 |
| JP | 2006-189708 | A | 7/2006 |
| JP | 2008-225315 | A | 9/2008 |
| JP | 2009-259127 | A | 11/2009 |
| JP | 2010-122748 | A | 6/2010 |
| JP | 2010-128416 | A | 6/2010 |
| JP | 2010-191155 | A | 9/2010 |
| JP | 2011-38335 | A | 2/2011 |
| JP | 4788732 | B2 | 10/2011 |
| JP | 2012-520018 | A | 8/2012 |
| JP | 2014-70740 | A | 4/2014 |
| JP | 2014-174213 | A | 9/2014 |
| JP | 2015-4921 | A | 1/2015 |
| JP | 2015-154259 | A | 8/2015 |
| JP | 2015-210059 | A | 11/2015 |
| JP | 2016-13747 | A | 1/2016 |
| JP | 2016-114346 | A | 6/2016 |
| WO | WO 2013/125032 | A1 | 8/2013 |
| WO | WO 2016/002145 | A1 | 1/2016 |
| WO | WO 2016/162956 | A1 | 10/2016 |

OTHER PUBLICATIONS

Extended European Search Report dated Oct. 25, 2019 in Patent Application No. 17870182.7, 8 pages.

* cited by examiner

EXAMPLE OF MESSAGE
FOR HAND TRUCK USERS

EXAMPLE OF MESSAGE
FOR PEOPLE ACCOMPANIED BY PETS

EXAMPLE OF MESSAGE FOR NONRESIDENTS

EXAMPLE OF MESSAGE FOR PEOPLE ACCOMPANIED BY PETS

EXAMPLE OF UI FOR EXPERTS

EXAMPLE OF UI FOR BEGINNERS

INFORMATION PROCESSING DEVICE, INFORMATION PROCESSING METHOD, AND RECORDING MEDIUM

TECHNICAL FIELD

The present disclosure relates to an information processing device, an information processing method, and a recording medium.

BACKGROUND ART

In general, cautions in an elevator, how to use a device that needs to be operated by a user him/herself in a store, and the like are communicated to users by being written on paper and posted in the surroundings. The information is unnecessary for a user who already has a thorough knowledge, but serves as useful information for a user who does not.

Here, in regard to information presentation technologies, for example, Patent Literature 1 below proposes an information processing device that controls selection of a method for reproducing advertisement data in accordance with a human body detection situation (detection by a motion detector), to achieve power-saving operation while keeping an effect of viewing and listening to advertisement in a store.

In addition, Patent Literature 2 below proposes a digital signage device that selects and reproduces appropriate advertisement data in accordance with the age group, sex, number, people flow, and time slot of audiences.

In addition, Patent Literature 3 below proposes a digital signage system that provides digital coupons or the like as payoffs to users in accordance with the position, number, age, sex, and the like of the users with respect to the digital signage.

In addition, Patent Literature 4 below proposes an electronic paper variable display function signage device that normally outputs advertisement and information display, and outputs evacuation guidance display or a specific message in case of emergency.

In addition, Patent Literature 5 below proposes an advertisement display system that compiles and analyzes information of customers collected from an IC card ticket, a credit card, or the like, and switches advertisement contents in accordance with the result.

In addition, Patent Literature 6 below proposes an image display method that, in the case where a statistical trend is found in features of customers, selects and displays advertisement that matches the trend.

In addition, Patent Literature 7 below proposes a refrigerator that displays refrigerator interior video.

CITATION LIST

Patent Literature

Patent Literature 1: JP 2010-191155A
Patent Literature 2: WO 13/125032
Patent Literature 3: JP 2012-520018T
Patent Literature 4: JP 2015-004921A
Patent Literature 5: JP 2008-225315A
Patent Literature 6: JP 2002-073321A
Patent Literature 7: JP 2002-81818A

DISCLOSURE OF INVENTION

Technical Problem

However, some sort of information is always presented in all of the information presentation technologies, which causes a problem in that text or figures being displayed on a display screen impairs surrounding scenery.

In addition, posting many labels showing a call for attention or how to use an object impairs designability of the object itself. In addition, there is a concern that leaving the labels in a messy state such as being ripped or coming off contributes to deterioration of public order.

Hence, the present disclosure proposes an information processing device, an information processing method, and a recording medium capable of appropriately presenting necessary information while maintaining scenery.

Solution to Problem

According to the present disclosure, there is proposed an information processing device including: a communication unit configured to receive sensor data detected by a sensor for grasping a surrounding situation; and a control unit configured to perform control to generate a control signal for displaying an image including appropriate information on a display unit installed around the sensor, in accordance with at least one of an attribute of a user, a situation of the user, or an environment detected from the sensor data, generate a control signal for displaying a blending image that blends into surroundings of the display unit on the display unit in a case where information presentation is determined to be unnecessary, and transmit the control signal to the display unit via the communication unit.

According to the present disclosure, there is proposed an information processing method including, by a processor: receiving, via a communication unit, sensor data detected by a sensor for grasping a surrounding situation; and performing control to generate a control signal for displaying an image including appropriate information on a display unit installed around the sensor, in accordance with at least one of an attribute of a user, a situation of the user, or an environment detected from the sensor data, generate a control signal for displaying a blending image that blends into surroundings of the display unit on the display unit in a case where information presentation is determined to be unnecessary, and transmit the control signal to the display unit via the communication unit.

According to the present disclosure, there is proposed a recording medium having a program recorded thereon, the program causing a computer to function as: a communication unit configured to receive sensor data detected by a sensor for grasping a surrounding situation; and a control unit configured to perform control to generate a control signal for displaying an image including appropriate information on a display unit installed around the sensor, in accordance with at least one of an attribute of a user, a situation of the user, or an environment detected from the sensor data, generate a control signal for displaying a blending image that blends into surroundings of the display unit on the display unit in a case where information presentation is determined to be unnecessary, and transmit the control signal to the display unit via the communication unit.

Advantageous Effects of Invention

According to the present disclosure as described above, it is possible to appropriately present necessary information while maintaining scenery.

Note that the effects described above are not necessarily limitative. With or in the place of the above effects, there may be achieved any one of the effects described in this specification or other effects that may be grasped from this specification.

MODE(S) FOR CARRYING OUT THE INVENTION

Figure 1:
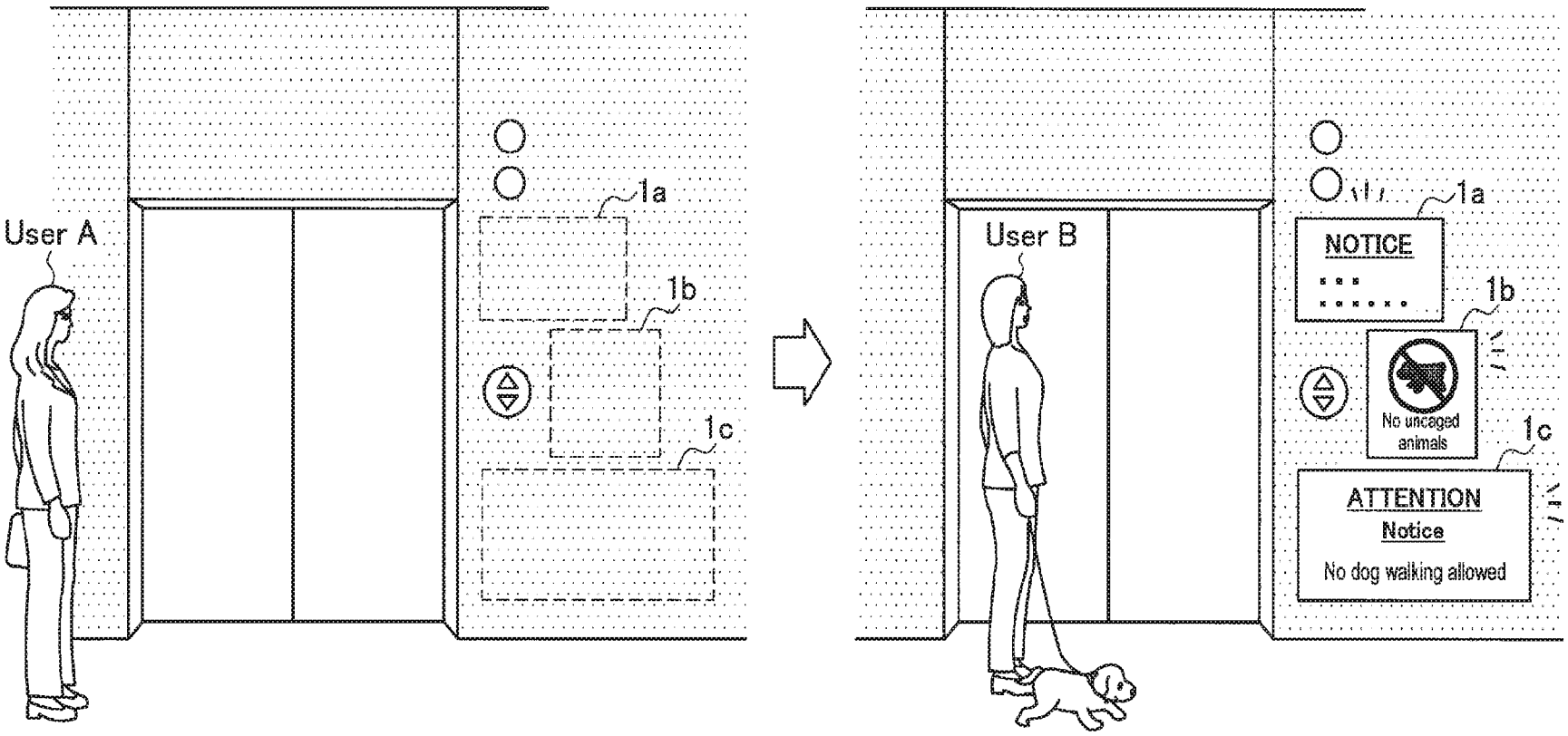
FIG. 1 is a diagram for describing an overview of an information processing system according to an embodiment of the present disclosure.

Hereinafter, (a) preferred embodiment(s) of the present disclosure will be described in detail with reference to the appended drawings. Note that, in this specification and the appended drawings, structural elements that have substantially the same function and structure are denoted with the same reference numerals, and repeated explanation of these structural elements is omitted.

In addition, description will be given in the following order.

1. Overview of information processing system according to embodiment of present disclosure
2. First example
2-1. Configuration
2-2. Operation processing
3. Second example
3-1. Configuration
3-2. Operation processing
4. Third example
4-1. Configuration
4-2. Operation processing
5. Fourth example
5-1. Configuration
5-2. Operation processing
6. Conclusion «1. Overview of Information Processing System According to Embodiment of Present Disclosure»

FIG. 1 is a diagram for describing an overview of an information processing system according to an embodiment of the present disclosure. As illustrated in FIG. 1, in the information processing system according to the present embodiment, information processing terminals 1 (1*a* to 1*c*) capable of presenting information display a camouflage image (blending image) that blends into the surroundings in the case where information presentation is determined to be unnecessary in accordance with a surrounding situation; thus, scenery can be maintained and necessary information can be presented appropriately. For example, when the information processing terminals 1*a* to 1*c* are installed around an elevator, displaying a pattern that blends into the surrounding pattern can prevent the scenery around the elevator from being impaired.

In this case, even in the case where user A comes to the front of the elevator, for example, information presentation is determined to be unnecessary because user A is not with a pet, and the information processing terminals 1*a* to 1*c* continue display of the pattern that blends into the surrounding pattern, as illustrated on the left of FIG. 1. On the other hand, in the case where user B comes to the front of the elevator, information presentation is determined to be necessary because user B is with a pet, and the information processing terminals 1*a* to 1*c* display cautions and rules for users with pets, as illustrated on the right of FIG. 1.

(Background)

As described above, posting many labels showing a call for attention or how to use an object impairs designability of the object itself. In addition, there is a concern that leaving the labels in a messy state such as being ripped or coming off contributes to deterioration of public order.

Figure 2:
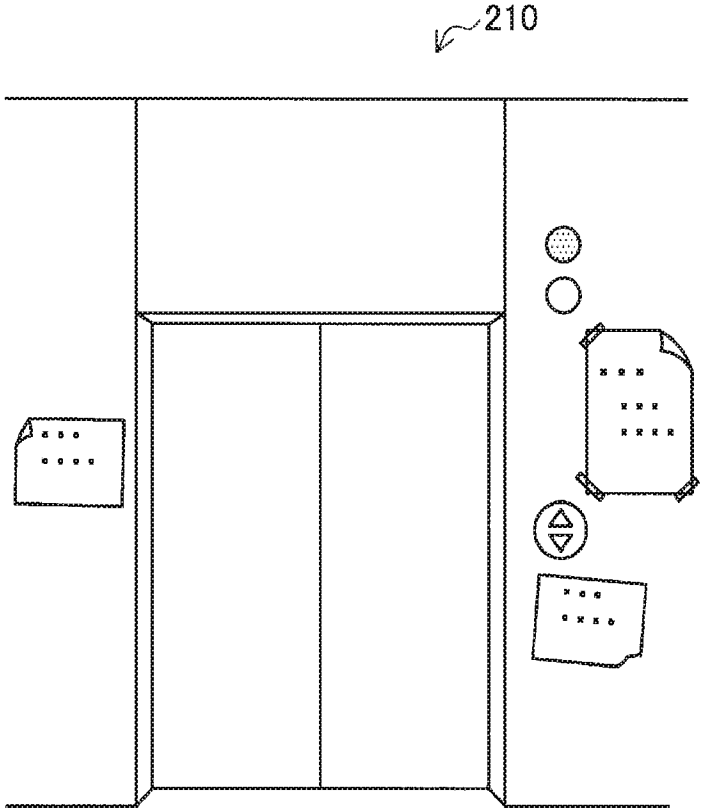
FIG. 2 is a diagram for describing a case where scenery is impaired by labels for calling attention etc.
Figure 2:
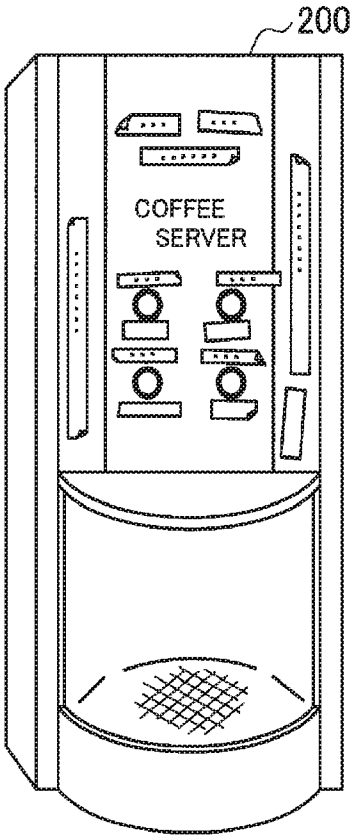

FIG. 2 is a diagram for describing a case where scenery is impaired by labels for calling attention etc. As illustrated in FIG. 2, for example, a coffee machine 200 that is placed in a store and is operated by a user him/herself to make coffee, an elevator hall 210 of an apartment, a hotel, a building, or the like, etc. often face an event in which the intended designability is impaired by labels for calling attention etc. In general, there is a problem in that trying to address all of various situations, such as variety of users, unfriendliness of the design itself, and calling the attention of a person who uses it for the first time, brings about difficulty, and the appearance and scenery originally designed by a designer are increasingly impaired. Such a problem also occurs in, for example, public facilities such as airports and stations. That is, a design designed by a spatial designer is spoiled by labels and banners for calling attention in some cases. In particular, the number of people walking in stations increases depending on commuting hours, and labels and banners indicating walking directions (keep right, keep left) are placed here and there to avoid trouble.

In addition, also from an emotional aspect, no one prefers disturbance of scenery, and disturbance of scenery may cause deterioration of the entire public order. For example, there is an idea, called the Broken Windows theory, that disturbance of scenery due to scribbling or the like causes deterioration of the entire public order.

That is, if labels are left in a messy state and scenery is disturbed, dirt, flaws, and the like of walls are less noticeable; thus, dirt and damage advance without being noticed, and the walls are likely to be intentionally soiled. There is a concern that acceleration of disturbance of scenery causes littering to start increasing in frequency, creates hangouts of delinquents, and triggers an increase of serious crimes such as property damage or thief Hence, to prevent disturbance of scenery due to labels and the like, the information processing system according to the present disclosure performs control to display a camouflage image so that the information processing terminal 1 blends into the surroundings while information presentation is unnecessary. Moreover, it makes it possible to display appropriate information in the case where information presentation is determined to be necessary in accordance with a surrounding situation (the degree of understanding, situation, environment, or the like of the user).

Figure 3:
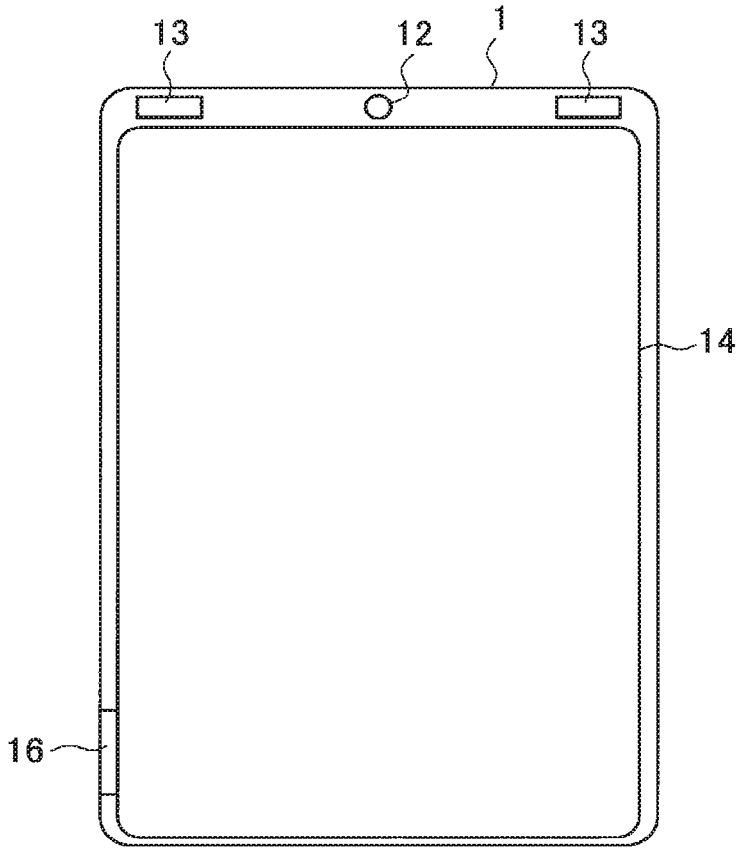
FIG. 3 illustrates an example of the exterior of an information processing terminal according to the present embodiment.

Here, the information processing terminal 1 (signage device) according to the present embodiment is implemented by an electronic paper terminal, for example. FIG. 3 illustrates an example of the exterior of the information processing terminal 1 according to the present embodiment. As illustrated in FIG. 3, the information processing terminal 1 is almost entirely provided with a display unit 14 (e.g., full-color electronic paper), and is partly provided with a camera 12 (e.g., a wide-angle camera) for recognizing a surrounding situation, audio output units (speakers) 13 (the number of the audio output units 13 may be one) for outputting voice for calling the user's attention etc. by means other than display, and a storage medium interface (I/F) 16 (e.g., a card slot, a USB interface, or the like) for reading data such as images captured by another camera from a storage medium. The information processing terminal 1 performs control to display a camouflage image for blending into the surroundings on the display unit 14 to normally prevent surrounding scenery from being impaired, and display appropriate information on the display unit 14 in the case where information presentation is determined to be necessary in accordance with a surrounding situation.

The overview of the information processing system according to the present embodiment has been described above. Next, such an information processing system according to the present embodiment will be specifically described using a plurality of examples.

«2. First Example»

First, a first example is described with reference to FIGS. 4 to 11. In the first example, description is given on a case where rules in using the elevator are presented to a user in the elevator hall described with reference to FIG. 1.

<2-1. Configuration>

Figure 4:
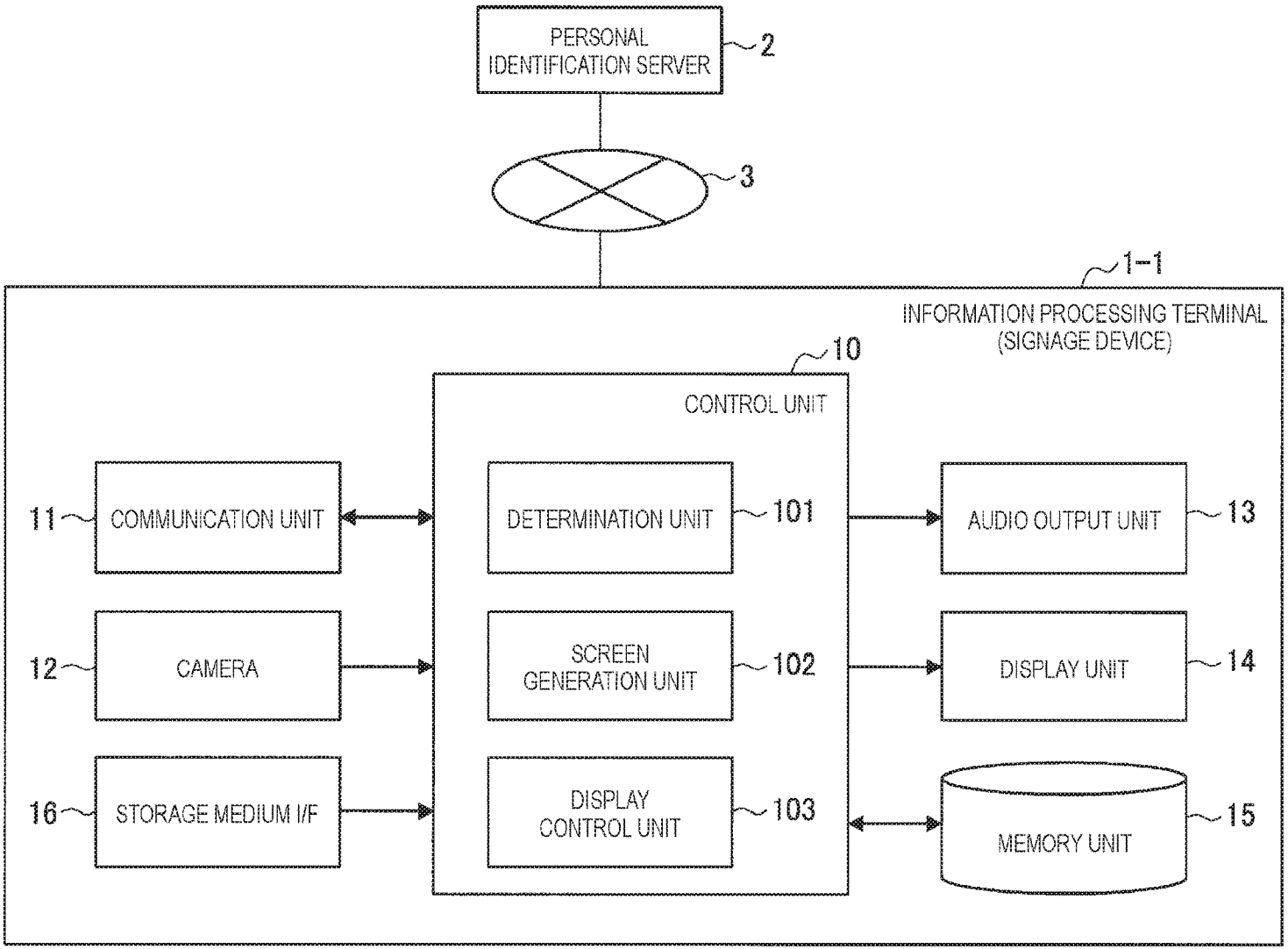
FIG. 4 illustrates an example of a configuration of an information processing system according to a first example.

First, a configuration of an information processing system according to the first example is described with reference to FIG. 4. As illustrated in FIG. 4, the information processing system according to the present example includes an information processing terminal 1-1 and a personal identification server 2, and the information processing terminal 1-1 and the personal identification server 2 are connected via a network 3.

The personal identification server 2 can perform facial recognition of a person imaged by the camera 12 of the information processing terminal 1-1 and send back personal identification and an attribute etc. of the person, in response to an inquiry from the information processing terminal 1-1. In the present example, for example, facial images (or their feature values or patterns) of residents of an apartment are registered in the personal identification server 2 in advance, and whether or not the person imaged by the camera 12 is a resident of the apartment can be determined in response to an inquiry from the information processing terminal 1-1.

As illustrated in FIG. 4, the information processing terminal 1-1 includes a control unit 10, a communication unit 11, the camera 12, the audio output unit 13, the display unit 14, a memory unit 15, and the storage medium I/F 16.

The control unit 10 functions as an arithmetic processing device and a control device, and controls the overall operation of the information processing terminal 1-1 in accordance with a variety of programs. The control unit 10 is implemented, for example, by an electronic circuit such as a central processing unit (CPU) and a microprocessor. In addition, the control unit 10 may include a read only memory (ROM) that stores a program, an operation parameter and the like to be used, and a random access memory (RAM) that temporarily stores a parameter and the like varying as appropriate.

In addition, the control unit 10 according to the present embodiment functions as a determination unit 101, a screen generation unit 102, and a display control unit 103. The determination unit 101 determines whether or not to perform information presentation in accordance with a surrounding situation. For example, the determination unit 101 determines whether or not to present information to a nearby target person on the basis of a degree of understanding (literacy, whether or not the person is accustomed, etc.), a situation (who/what the person is with, the aim or purpose of use, etc.), or a change in environment (people flow, date and time, an event, etc.) of the target person. Thus, a UI or contents can be presented dynamically.

The screen generation unit 102 generates a screen to be displayed on the display unit 14 in accordance with a result of determination by the determination unit 101. For example, in the case where the determination unit 101 determines that information presentation is necessary, the screen generation unit 102 generates a screen including information to be presented to the target person (the information may be set in advance or may be selected in accordance with the target person). On the other hand, in the case where the determination unit 101 determines that information presentation is unnecessary, the screen generation unit 102 generates a screen of a camouflage image that blends into the surrounding scenery. Thus, surrounding scenery can be prevented from being impaired in the case where information presentation is not performed.

The display control unit 103 performs control to display the screen generated by the screen generation unit 102 on the display unit 14.

The communication unit 11 connects to the network 3 in a wired/wireless manner, and transmits and receives data to and from the personal identification server 2 on the network. For example, the communication unit 11 connects by communication to the network 3 by a wired/wireless local area network (LAN), Wi-Fi (registered trademark), a mobile communication network (long term evolution (LTE), 3rd Generation Mobile Telecommunications (3G)), or the like.

The communication unit 11 according to the present example transmits a facial image of the target person imaged by the camera 12 to the personal identification server 2, and requests identification of whether or not the person is a resident of the apartment. Note that personal identification is performed in the personal identification server 2 (cloud) in the present example, but the present example is not limited to this, and personal identification may be performed in the information processing terminal 1-1 (local). Particularly in the case of an apartment, a large-scale memory area is unnecessary because the number of residents is limited.

The camera 12 includes a lens system including an imaging lens, a diaphragm, a zoom lens, a focus lens, and the like, a drive system that causes the lens system to perform focus operation and zoom operation, a solid-state image sensor array that generates an imaging signal by photoelectrically converting imaging light obtained by the lens system, and the like. The solid-state image sensor array may be implemented by, for example, a charge coupled device (CCD) sensor array or a complementary metal oxide semiconductor (CMOS) sensor array.

The camera 12 according to the present example images a user of the elevator, for example, and outputs a captured image to the control unit 10.

The audio output unit 13 includes a speaker that reproduces audio signals and an amplifier circuit for the speaker. Under the control of the control unit 10, when a display screen of the display unit 14 is switched by the display control unit 103, for example, the audio output unit 13 can attract the user's attention by outputting some sort of voice or sound to make the user notice a change in display.

Under the control of the display control unit 103, the display unit 14 displays an information presentation screen or a camouflage image. In addition, as described above, the display unit 14 is implemented by an electronic paper display, for example.

The memory unit 15 is implemented by a read only memory (ROM) that stores a program, an operation parameter and the like to be used for processing by the control unit 10, and a random access memory (RAM) that temporarily stores a parameter and the like varying as appropriate. For example, the memory unit 15 stores various message information for elevator users. In addition, in the case of performing personal identification in the information processing terminal 1-1, facial images of residents of the apartment are registered in the memory unit 15 in advance.

The storage medium I/F 16 is an interface for reading information from a storage medium, and for example, a card slot, a USB interface, or the like is assumed. In the present embodiment, for example, a captured image of the elevator hall captured by another camera may be acquired from the storage medium, and a camouflage image may be generated by the screen generation unit 102 of the control unit 10.

The configuration of the information processing terminal 1-1 according to the present embodiment has been specifically described above. Note that the configuration of the information processing terminal 1-1 is not limited to the example illustrated in FIG. 4, and may further include an audio input unit (microphone), various sensors (a positional information acquisition unit, a pressure sensor, an environment sensor, etc.), or an operation input unit (a touch panel etc.), for example. In addition, at least part of the configuration of the information processing terminal 1-1 illustrated in FIG. 4 may be in a separate body (e.g., the server side).

<2-2. Operation Processing>

Figure 5:
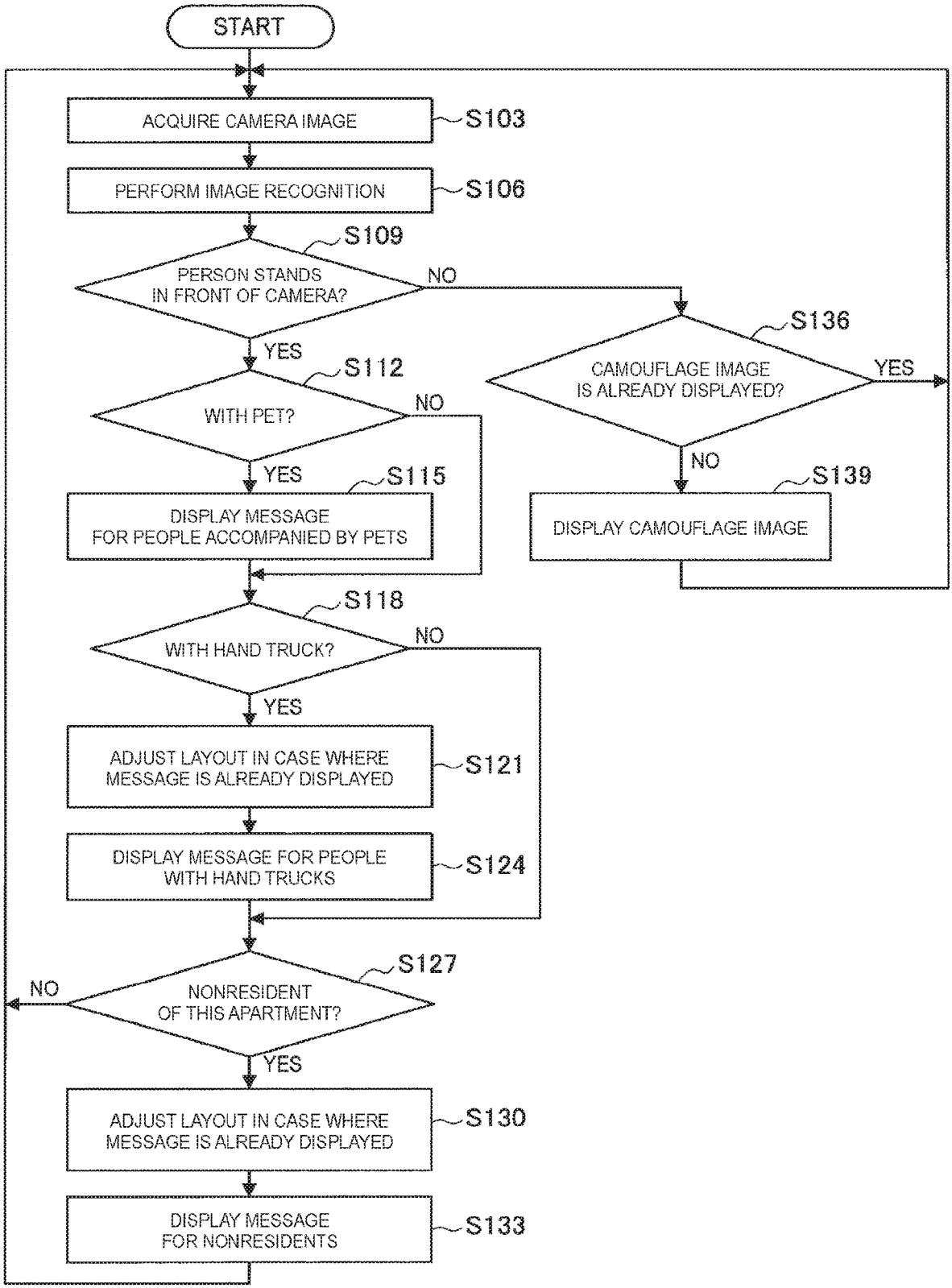
FIG. 5 is a flowchart illustrating operation processing of information presentation according to the first example.

First, operation processing of information presentation according to the first example is described with reference to FIG. 5. FIG. 5 is a flowchart illustrating operation processing of information presentation according to the present example.

As illustrated in FIG. 5, first, the information processing terminal 1-1 installed in the elevator hall acquires a captured image of the elevator hall with the camera 12 (step S103).

Next, the determination unit 101 of the information processing terminal 1-1 performs image recognition (step S106), and determines whether a person is standing in front of the camera, that is, whether or not there is an elevator user (step S109).

Then, in the case where there is a person in front of the camera (Yes in step S109), the determination unit 101 determines whether or not the person is with a pet (mainly an animal such as a dog or a cat) on the basis of a result of image recognition (step S112).

Next, in the case where the person is determined to be with a pet (Yes in step S112), the screen generation unit 102 generates a screen displaying a message for people accompanied by pets, and the display control unit 103 displays the screen on the display unit 14 (step S115).

Then, whether or not the person has a hand truck is determined (step S118), and in the case where the person has a hand truck (Yes in step S118), layout is adjusted in the case where a message is already displayed (step S121). For example, in the case where there is a plurality of people in front of the elevator and a message for people accompanied by pets is already displayed, layout of the message for people accompanied by pets is adjusted to create a region where a new message can be displayed.

Next, the information processing terminal 1-1 generates a message for people with hand trucks, and displays the message (step S124).

Then, personal identification is performed on the basis of the captured image of the person, and whether or not the person is a resident of the apartment is determined (step S127). A request may be made of the personal identification server 2 for personal identification, for example.

Next, in the case where the person is determined not to be a resident of the apartment (Yes in step S127), a message for nonresidents needs to be displayed, but layout is adjusted in the case where a message is already displayed (step S130).

Then, the information processing terminal 1-1 displays a message for nonresidents (step S133). Thus, a person who uses the elevator of this apartment for the first time can grasp the rules of the elevator.

Figure 6:
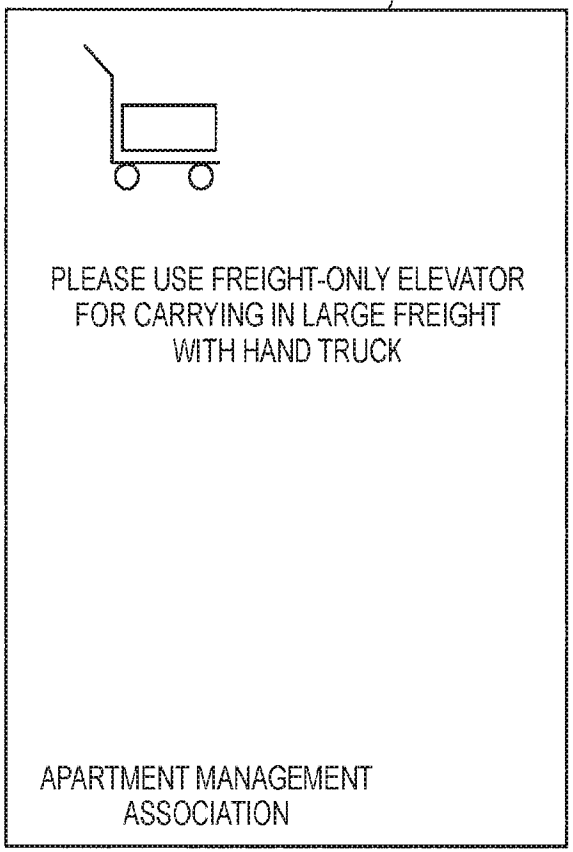
FIG. 6 illustrates an example of a message for people with pets and an example of a message for hand truck users according to the first example.
Figure 6:
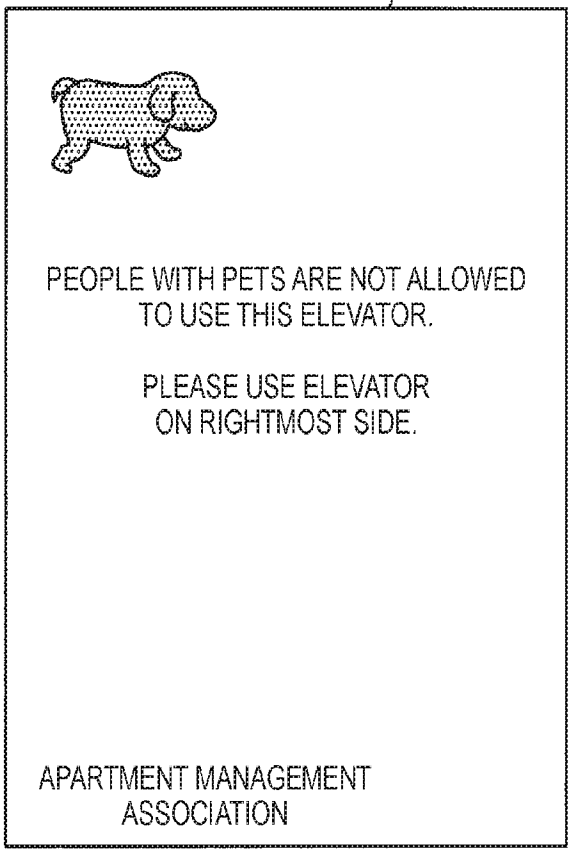
Figure 7:
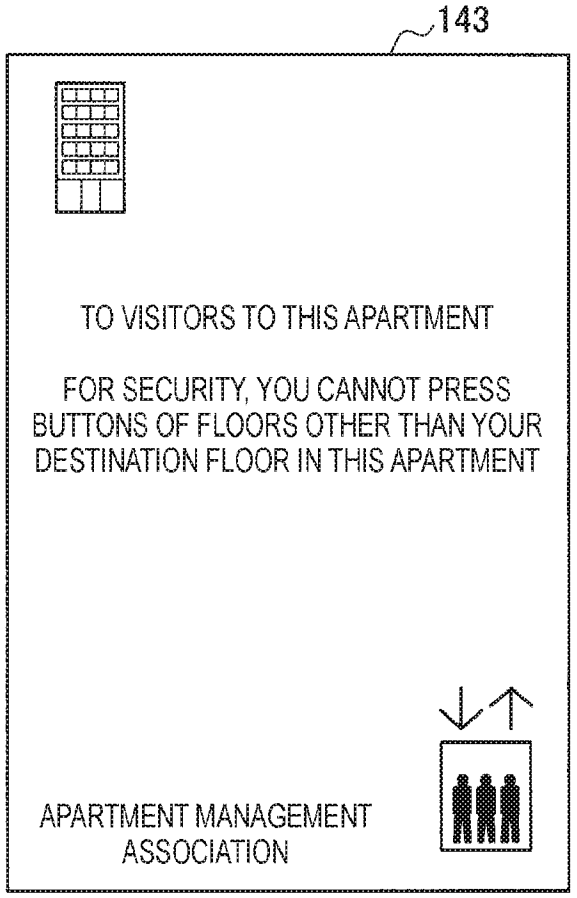
FIG. 7 illustrates an example of displaying a plurality of messages and an example of a message for nonresidents according to the first example.
Figure 7:
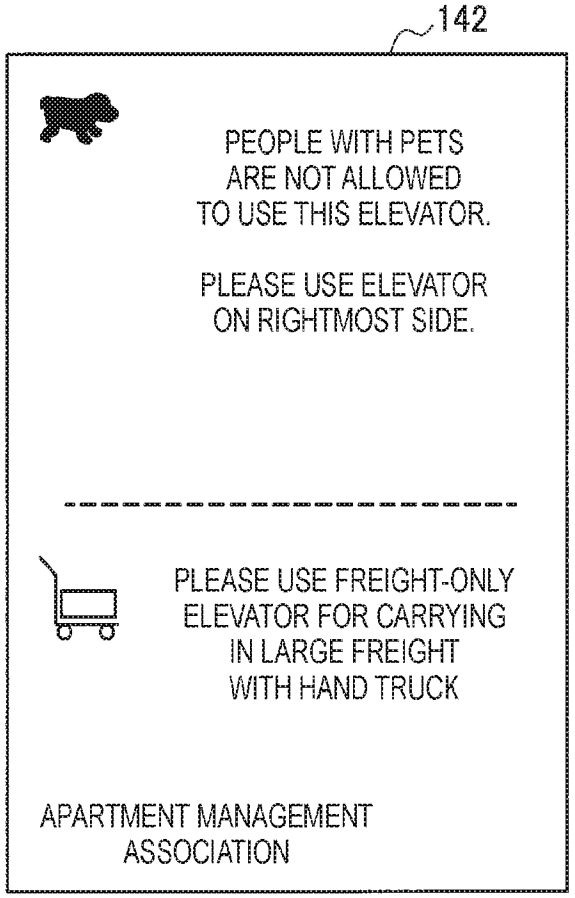

Note that FIGS. 6 and 7 illustrate examples of messages displayed on the display unit 14. FIG. 6 illustrates an example of a message for people with pets and an example of a message for hand truck users. As illustrated on the left of FIG. 6, a message screen 140 displays cautions for people with pets. In addition, as illustrated on the right of FIG. 6, a message screen 141 displays cautions for people with hand trucks.

In addition, FIG. 7 illustrates an example of displaying a plurality of messages and an example of a message for nonresidents. As illustrated on the left of FIG. 7, a message region of a message screen 142 is divided, and both a message for people with pets and a message for people with hand trucks are displayed, for example. Note that a method for displaying a plurality of messages is not limited to this, and for example, a plurality of messages may be displayed alternately at certain time intervals, or may be displayed while being scrolled vertically or horizontally.

In addition, as illustrated on the right of FIG. 7, a message screen 143 displays cautions for nonresidents. Note that personal identification of whether or not the person is a resident of the apartment is not limited to recognition of a facial image. For example, some apartments have a mechanism in which an elevator is called when a key (or a card) is touched in terms of security, and in the mechanism, the elevator automatically goes down to the entrance floor when the lock is released with an intercom in the case where a guest comes. Consequently, whether the person is a resident or a guest (nonresident) may be identified depending on whether a key is used or an intercom is used.

Then, in the case where no person is standing in front of the camera (no person is waiting for the elevator) (No in step S109), and in the case where a camouflage image is already displayed (No in step S136), display is kept as it is. Specifically, using electronic paper for the display unit 14 eliminates the need for electric power for retaining an image once displayed; hence, new processing is unnecessary if a camouflage image is already displayed.

On the other hand, in the case where a camouflage image is not displayed (e.g., in the case where the above-described message screens 140 to 143 are displayed) (No in step S136), a camouflage image is displayed (step S139).

In this manner, a predetermined message is presented in the case where a person who has come to the front of the elevator is a user for which a message is necessary, such as a person with a pet, and display of a camouflage image is kept in the case where the person does not fall under target people to which a message is to be presented; thus, scenery of the elevator hall can be maintained.

The operation processing according to the present example has been specifically described above. Note that the operation processing described with reference to FIG. 5 exemplifies some conditions for information presentation, but these are examples, and whether to present information can also be determined on the basis of another condition, as a matter of course. For example, in the case where a bicycle is recognized, a message indicating cautions for people with bicycles, such as guiding them to an elevator for carrying in bicycles, may be displayed.

In addition, the first example describes a case where the information processing terminal 1-1 is installed in an elevator hall, but the present example is not limited to this; for example, the information processing terminal 1-1 may be installed in a non-smoking place, caused to usually display a camouflage image, and switched to a display screen of a "non-smoking" sign in the case where a person who is about to smoke (or is smoking) is recognized.

(Generation of Camouflage Image)

Next, generation of a camouflage image is described with reference to FIGS. 8 to 11.

Figure 8:
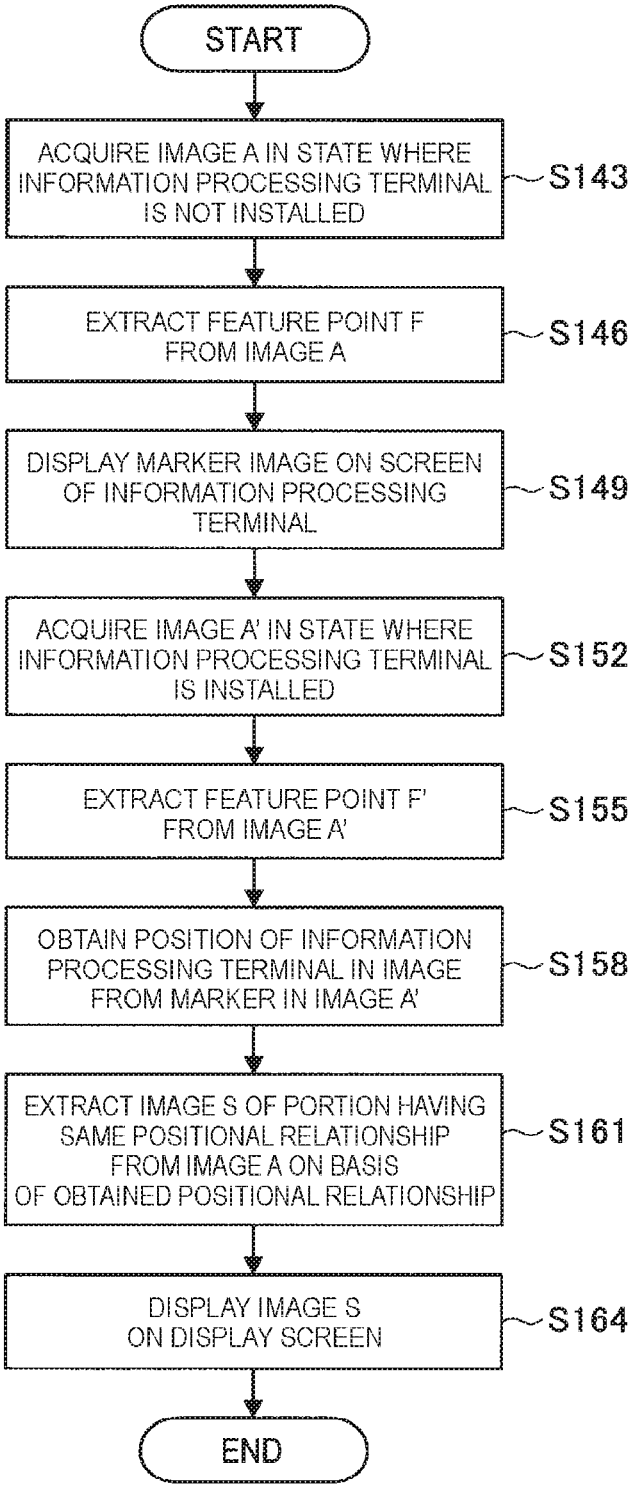
FIG. 8 is a flowchart illustrating camouflage image generation processing according to the first example.
Figure 9:
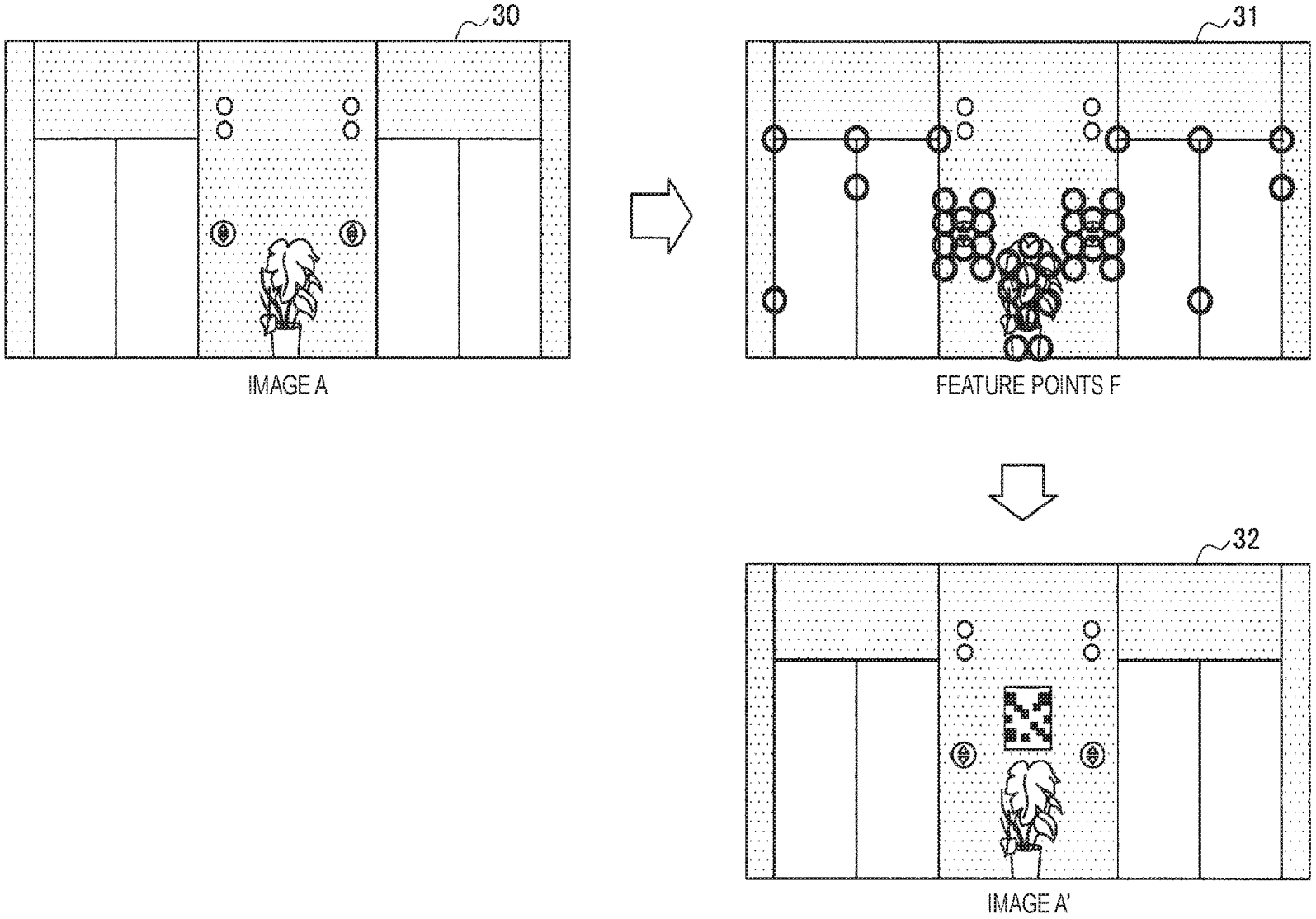
FIG. 9 illustrates examples of images used in a process of generating a camouflage image.
Figure 10:
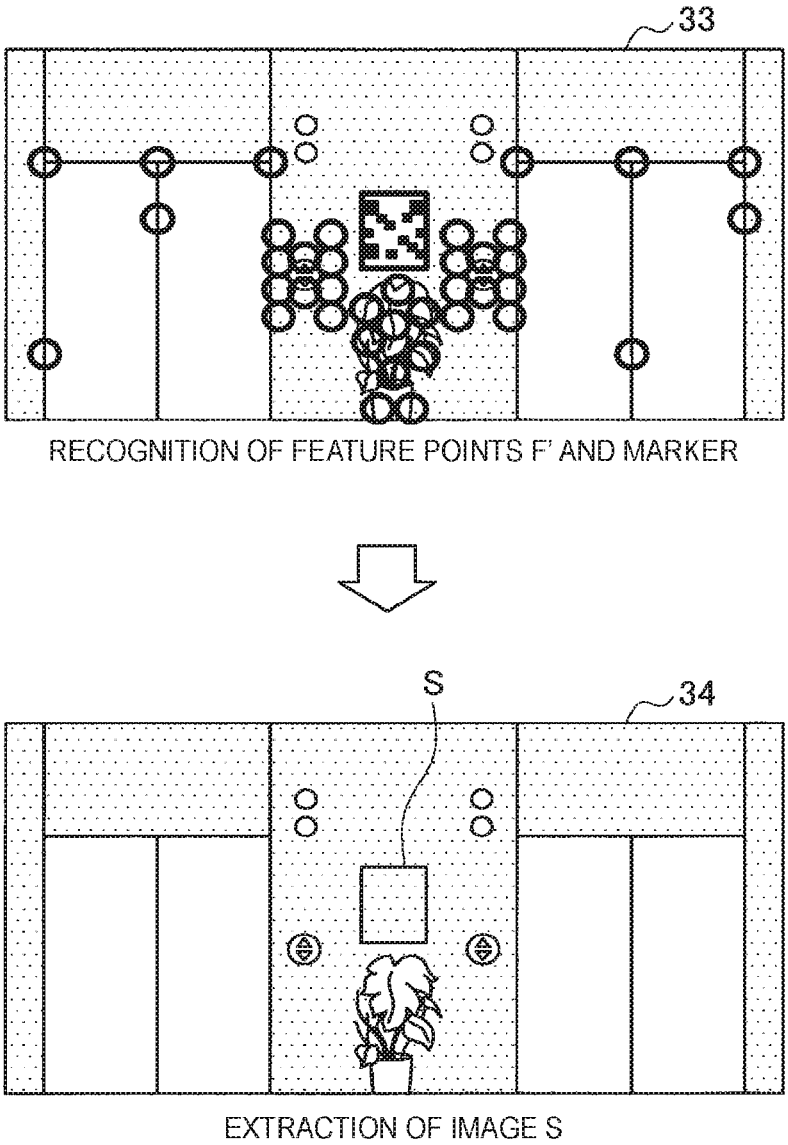
FIG. 10 illustrates examples of images used in a process of generating a camouflage image.

FIG. 8 is a flowchart illustrating camouflage image generation processing according to the present example. FIGS. 9 to 10 illustrate examples of images used in a process of generating a camouflage image.

As illustrated in FIG. 8, first, in a state where the information processing terminal 1-1 is not installed, a place where it is to be installed is imaged with a digital camera or the like, and the information processing terminal 1-1 acquires the image A (see an image 30 illustrated in FIG. 9) (step S143). A method for acquisition is not particularly limited; the image may be received from the digital camera or the like wirelessly via the communication unit 11, or may be acquired from a storage medium, such as a USB or a SD card, by using a storage medium I/F. In addition, the place in a state where the information processing terminal 1-1 is not installed may be imaged with the camera 12 of the information processing terminal 1-1. Note that this processing describes a case of being performed in the information processing terminal 1-1, but the captured image is transmitted to a server in the case where this processing is performed on the server side.

Next, a feature point F of the acquired image A is extracted (see an image 31 illustrated in FIG. 9) (step S146). For this feature point, feature point extraction (e.g. SIFT, SURF, Haar-like, etc.) generally performed in marker-less AR, image recognition, and the like is used.

Then, in response to a user operation, a marker image is displayed on the display unit 14 of the information processing terminal 1-1 (step S149). A user (e.g., an administrator) fixes the information processing terminal 1-1 on which the marker image is displayed to a place for actual installation. The marker image is an image for recognizing the information processing terminal 1-1 in the captured image, and may be any marker image as long as it can be recognized.

Next, the information processing terminal 1-1 acquires an image A' (see an image 32 in FIG. 9) obtained by imaging the installation place in a state where the information processing terminal 1-1 is installed (step S152).

Then, the screen generation unit 102 of the information processing terminal 1-1 extracts a feature point F' from the image A' (see an image 33 in FIG. 10) (step S155). In addition, the screen generation unit 102 recognizes a marker image from the image A', and obtains a position (step S158). Note that a feature point is not extracted in a marker portion in the image 33 in FIG. 10, but this is for making the drawing easy to see for explanation; a feature point is actually likely to be extracted.

Next, the screen generation unit 102 matches the feature point F to the feature point F', thereby detecting a difference in position, rotation, and size between the image A and the image A', and can detect which portion of the image A the installation position of the information processing terminal 1-1 (i.e., a position of the marker image) in the image A' corresponds to.

Then, on the basis of the obtained positional relationship, the screen generation unit 102 extracts, from the image A, an image S of a portion having the same positional relationship as the position of the marker image in the image A' (i.e., a portion corresponding to a position where the information processing terminal 1-1 is installed) (see an image 34 in FIG. 10) (step S161). The image S extracted from the image A corresponds to a camouflage image.

Figure 11:
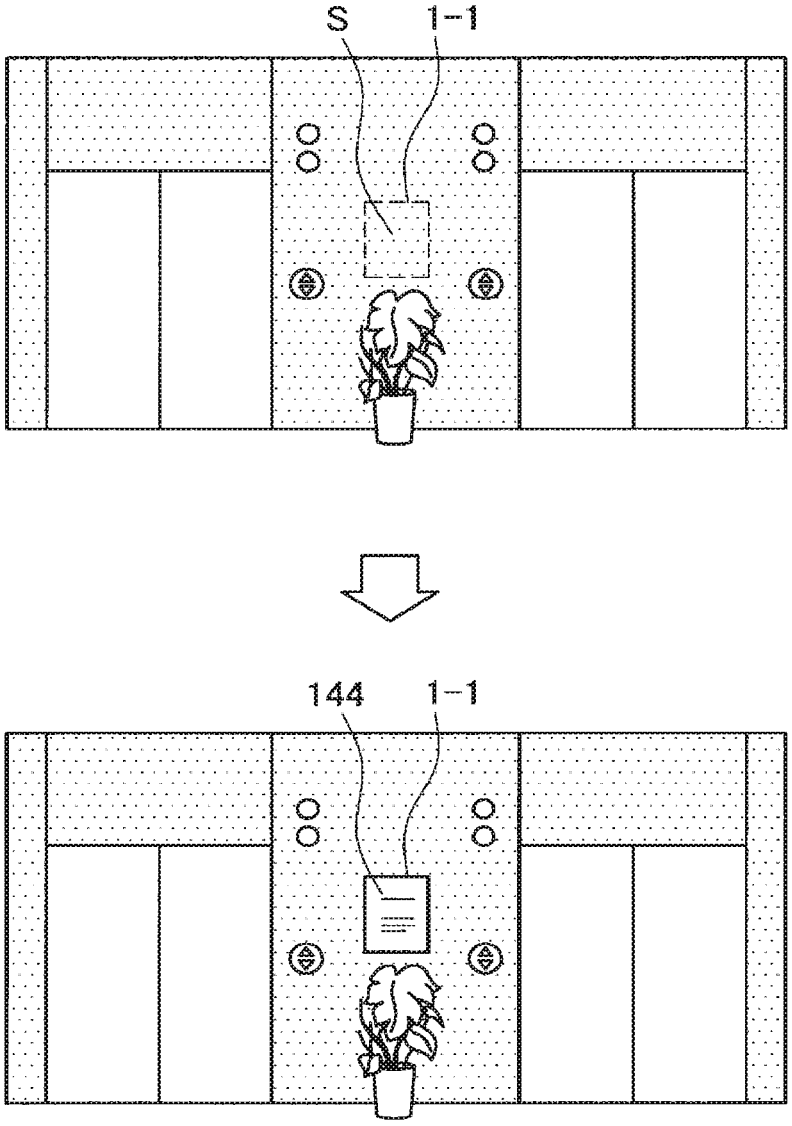
FIG. 11 illustrates an example of switching between display of a camouflage image and a message image in an information processing terminal.

Then, the information processing terminal 1-1 displays the image S on the display unit 14, which can cause the information processing terminal 1-1 to blend into surrounding scenery (step S164). Here, FIG. 11 illustrates an example of switching between display of the generated camouflage image (image S) and a message image. Displaying the camouflage image (image S) on the information processing terminal 1-1, as illustrated in the upper stage of FIG. 11, causes the information processing terminal 1-1 to blend into the surroundings to make it hardly noticeable; thus, scenery of the elevator hall can be maintained. On the other hand, in the case where it becomes necessary to present a message for elevator users, displaying a message image 144 on the information processing terminal 1-1, as illustrated in the lower stage of FIG. 11, makes it possible to appropriately call the user's attention.

The camouflage image generation processing according to the present example has been specifically described above. Note that generation of a camouflage image is not limited to being performed in the information processing terminal 1-1, and may be performed on a server, for example.

In addition, the above-described example describes a case where the display unit 14 of the information processing terminal 1-1 is implemented by electronic paper, but the present disclosure is not limited to this. For example, there may be a method of presenting a message by a projection scheme by using a projector. In this case, to maintain scenery, it is sufficient if video is not projected (in other words, the original background is made to be seen as it is) when information presentation is unnecessary, which eliminates the need for creating a camouflage image.

Furthermore, in the case of considering implementation using a large digital signage on ordinary streets, even a large digital signage can be made to blend into scenery by using the mechanism of optical camouflage. Specifically, for example, providing a display screen on both sides of a digital signage, and displaying captured images captured by cameras provided on the respective opposite sides produces a state where a scene beyond the digital signage can be seen; thus, scenery can be maintained. Note that a captured image captured by a camera in real time may be displayed as a camouflage image, or a camouflage image may be generated in advance.

«3. Second Example»

Next, a case of, in a self-service coffee server placed in a convenience store or the like, presenting a call for attention or explanation about the coffee server to a user will be described with reference to FIGS. 12 to 14.

Figure 12:
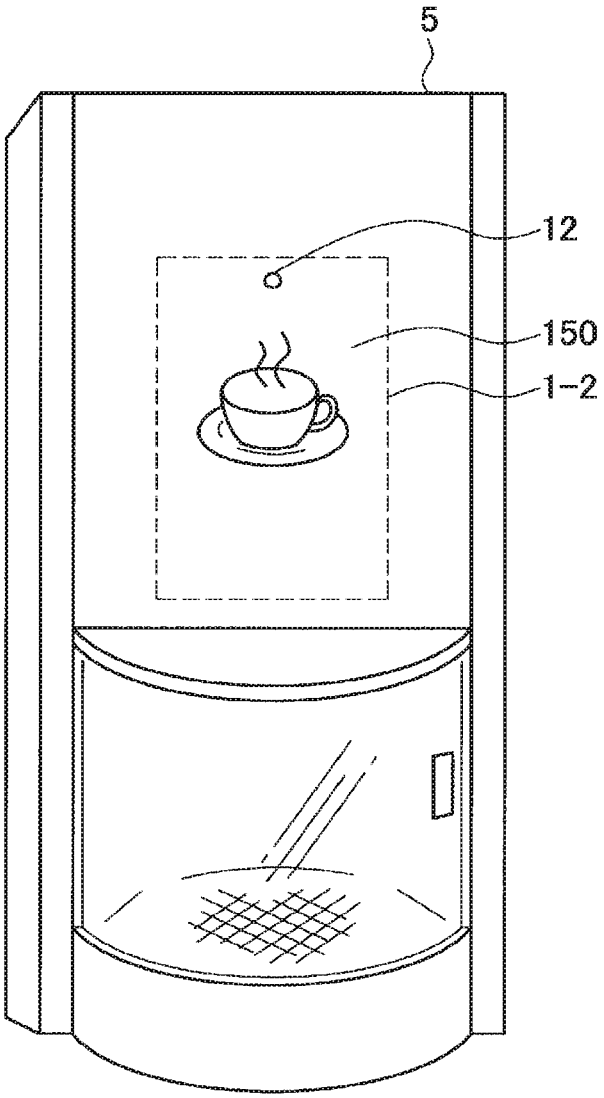
FIG. 12 is a diagram for describing an overview of a second example.

FIG. 12 is a diagram for describing an overview of a second example. In recent years, self-service coffee servers have become widely used in convenience stores or the like, and coffee servers have come to have higher designability. However, in terms of design, notation is written in foreign language or omitted, or only buttons are provided in many cases, which makes the design difficult to understand for a person who is unaccustomed or a person who uses it for the first time. Recently, to overcome such inconvenience, clerks posting labels, or posting stickers or the like showing the meaning of buttons are often observed, but this causes a problem of impairing designability and producing a messy atmosphere.

Hence, in the present example, in an information processing terminal 1-2 installed in a coffee server 5 as illustrated in FIG. 12, a camouflage image 150 (e.g., a stylish exterior, such as illustration of coffee) that blends into scenery is usually displayed; thus, scenery can be maintained. Moreover, for example, personal identification of a user is performed with the camera 12, and if the user is an expert (a person who has used it many times), a UI for experts (e.g., a camouflage image that is a screen with high designability having no explanation and does not impair surrounding scenery), is displayed. On the other hand, if the user is a beginner (a person who uses it for the first time, or a person who is estimated to be unaccustomed to operations, such as an elderly person or a child), a UI for beginners (e.g., a screen having low designability but displaying explanation that is easy to understand) is displayed. This makes it possible to present information as appropriate when needed, while usually maintaining scenery.

<3-1. Configuration>

First, a configuration of an information processing system according to the second example is described with reference to FIG. 13. As illustrated in FIG. 13, the information processing system according to the present example includes an information processing terminal 1-2 and the personal identification server 2, and the information processing terminal 1-2 and the personal identification server 2 are connected via the network 3.

As in the first example, the personal identification server 2 can perform facial recognition of a person imaged by the camera 12 of the information processing terminal 1-2 and send back personal identification and an attribute etc. of the person, in response to an inquiry from the information processing terminal 1-2. Note that in the present example, the personal identification server 2 can perform personal identification on the basis of a facial image (or its feature value or pattern) of a user of a convenience store, for example, and further accumulate data, such as the number of uses or an operation time in use, of the identified user. In addition, the personal identification server 2 can determine whether or not the person imaged by the camera 12 is an expert in response to an inquiry from the information processing terminal 1-2.

Figure 13:
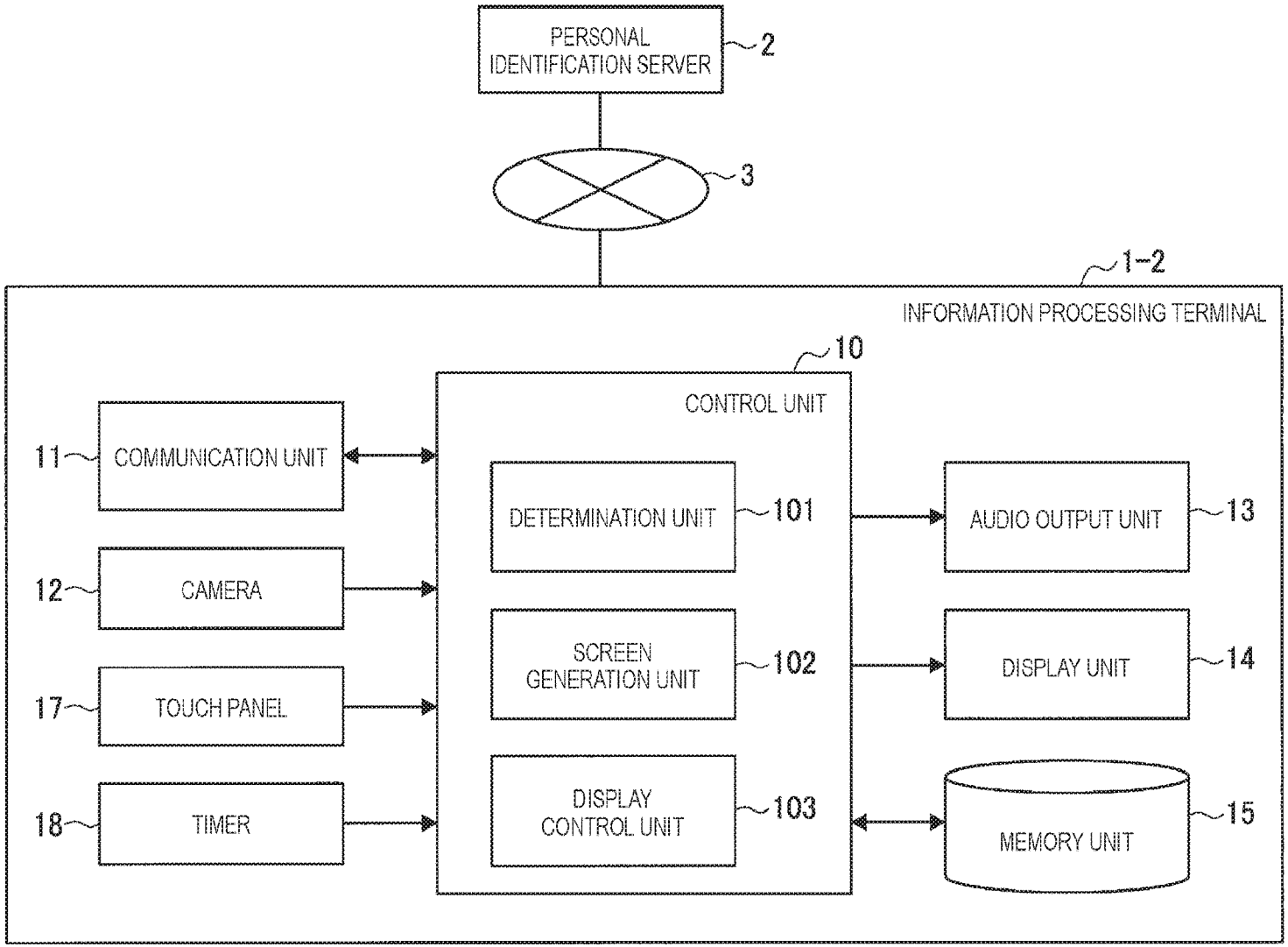
FIG. 13 illustrates an example of a configuration of an information processing system according to the second example.

As illustrated in FIG. 13, the information processing terminal 1-2 includes the control unit 10, the communication unit 11, the camera 12, the audio output unit 13, the display unit 14, the memory unit 15, a touch panel 17, and a timer 18.

As in the first example, the control unit 10 functions as the determination unit 101, the screen generation unit 102, and the display control unit 103. The determination unit 101 according to the present example determines what kind of information presentation is to be performed in accordance with whether or not a user who uses the coffee server is an expert (the degree of understanding of the target person).

The screen generation unit 102 generates a screen to be displayed on the display unit 14 in accordance with a result of determination by the determination unit 101. For example, in the case where the determination unit 101 determines that information presentation for experts is necessary, the screen generation unit 102 generates a UI for experts. As the UI for experts, a UI that has high designability and makes scenery better is assumed, for example. On the other hand, in the case where the determination unit 101 determines that information presentation for beginners is necessary, a UI for beginners is generated. In addition, the screen generation unit 102 may generate a default UI (a camouflage image that does not impair scenery) to be displayed in the case where there is no user or the case where an operation ends. The default UI may be made to blend into the background (have the same color and pattern as the coffee server 5). In the example illustrated in FIG. 12, an illustration of coffee may be displayed as a minimum of display enough for the coffee server to be recognized as a coffee server so that a customer can at least find it, and the background may have the same color and pattern as the coffee server 5. Note that as colors of various operation screens, colors in harmony with the atmosphere of the store may be used.

The display control unit 103 performs control to display the screen generated by the screen generation unit 102 on the display unit 14.

The communication unit 11, the camera 12, the audio output unit 13, the display unit 14, the memory unit 15 are similar to those in the first example; hence, description is omitted here.

The touch panel 17 is provided in the display unit 14, detects a user's operation input to an operation screen (a UI for experts or a UI for beginners) displayed on the display unit 14, and outputs the operation input to the control unit 10.

The configuration of the information processing terminal 1-1 according to the present embodiment has been specifically described above. Note that the configuration of the information processing terminal 1-1 is not limited to the example illustrated in FIG. 4, and may further include an audio input unit (microphone), various sensors (a positional information acquisition unit, a pressure sensor, an environment sensor, etc.), or an operation input unit (a touch panel etc.), for example. In addition, at least part of the configuration of the information processing terminal 1-1 illustrated in FIG. 4 may be in a separate body (e.g., the server side). The information processing terminal 1-2 transmits, via the communication unit 11, information of the operation input by the user to the coffee server 5 on which the information processing terminal 1-2 is mounted.

The timer 18 measures a time of the user's operation on the coffee server 5 or the operation screen displayed on the display unit 14, and outputs the time to the control unit 10. Such an operation time may be transmitted to the personal identification server 2 from the communication unit 11 and accumulated as information regarding the user operation.

The configuration of the information processing terminal 1-2 according to the present embodiment has been specifically described above. Note that the configuration of the information processing terminal 1-2 is not limited to the example illustrated in FIG. 13, and may further include an audio input unit (microphone), or various sensors (a positional information acquisition unit, a pressure sensor, an environment sensor, etc.), for example. In addition, at least part of the configuration of the information processing terminal 1-1 illustrated in FIG. 13 may be in a separate body (e.g., the coffee server 5, or a cloud server on a network). Specifically, for example, the camera 12 may be provided above the front surface of the coffee server 5, and captured images may be continuously transmitted to the information processing terminal 1-1 in a wired/wireless manner.

<3-2. Operation Processing>

Next, operation processing according to the present example is described with reference to FIG. 14. FIG. 14 is a flowchart illustrating operation processing of the information processing system according to the second example.

Figure 14:
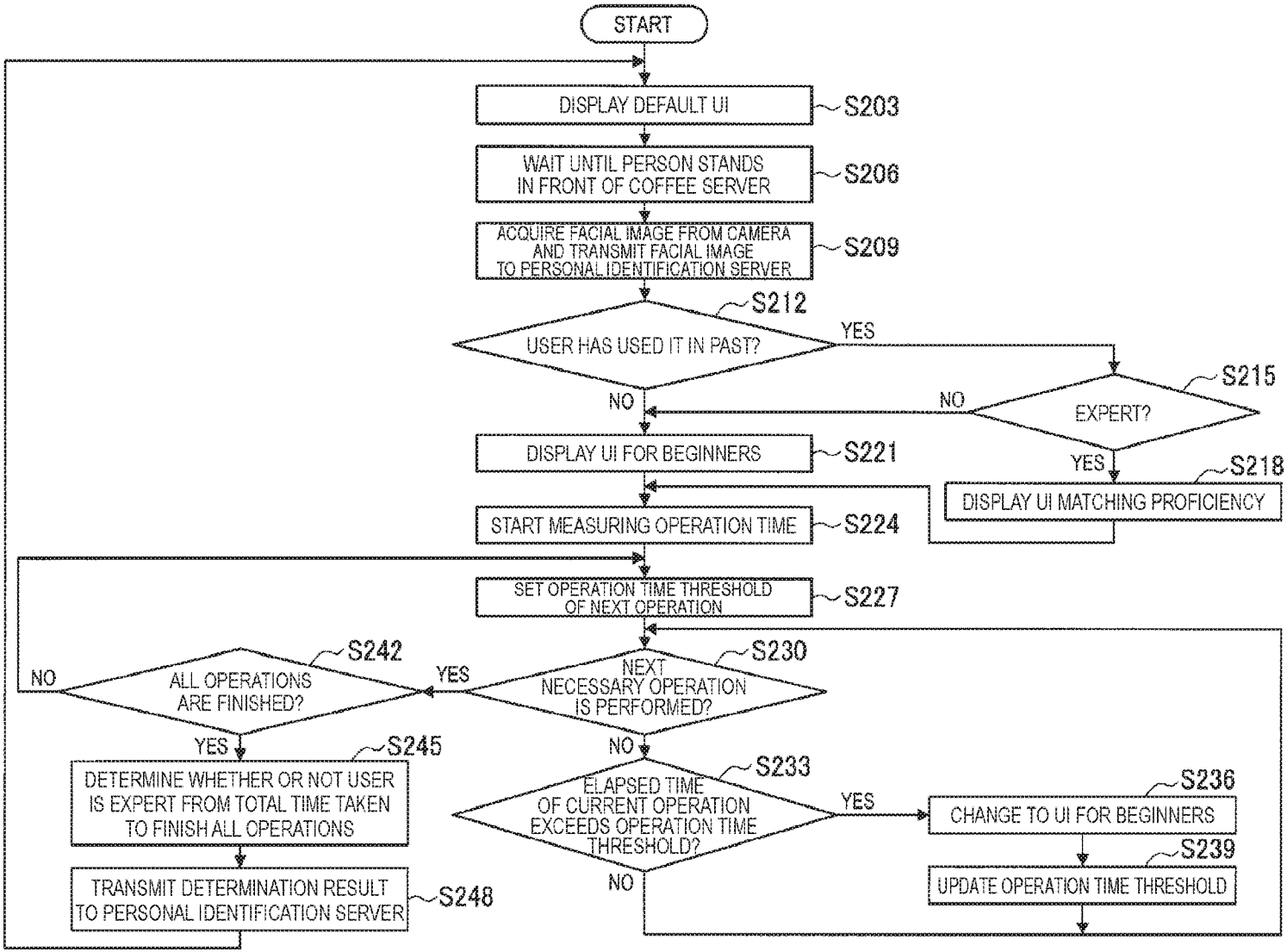
FIG. 14 is a flowchart illustrating operation processing of the information processing system according to the second example.

As illustrated in FIG. 14, first, the information processing terminal 1-2 displays a default UI on the display unit 14 (step S203). The default UI may be a UI with high designability, or may be a UI that is made unnoticeable by having a color and pattern that completely blend into the coffee server 5 in the background.

Next, the camera 12 keeps imaging the front (i.e., the front of the coffee server 5), and waits until a person stands in the front (a user appears) (step S206). Note that to distinguish a user from a person who simply goes past the front of the coffee server 5, determination may be made more accurately by considering whether the person in the front confronts the coffee server 5, whether the face faces the coffee server 5, whether the person is standing still, or the like.

Then, when a user appears, the information processing terminal 1-2 transmits a facial image of the user acquired by the camera 12 to the personal identification server 2, and checks whether or not the user has ever used the coffee server 5 in the past (step S209). The personal identification server 2 performs personal identification on the basis of the facial image, and sends back, to the information processing terminal 1-2, whether or not the user has ever used the coffee server 5 in the past and, in the case where the user has ever used the coffee server 5, information indicating whether or not the user is an expert (e.g., including proficiency).

Here, an example of determination of an expert will be described. Whether or not the user is an expert may be calculated in accordance with the number of uses, a recent use situation (whether the user has used it recently, whether that was half a year or more ago, etc.), and a user attribute (age etc.), or may be calculated on the basis of an operation time. For example, in the case where an operation procedure of the coffee server 5 has the following steps (n), an operation time (T) taken for each step is measured as $T_n$ (n=1, 2, . . . 5).

(Operation 1) Stand in front of the coffee server 5, and open the cover of a cup space.

(Operation 2) Place an empty cup in the cup space.

(Operation 3) Close the cover of the cup space.

(Operation 4) Press a drink type button (e.g., any one from combinations of hot/ice and regular/large).

(Operation 5) When pouring of coffee ends, open the cover of the cup space and take out coffee.

Moreover, as shown in Table 1 below, thresholds for experts and beginners may be provided for each $T_n$, and for example, the user may be determined to be a "beginner" if at least one $T_n$ is greater than the beginner threshold, and the user may be determined to be an "expert" if all $T_n$s are within the expert threshold. In addition, determination may be made as follows: the user is an "expert" if the sum of $T_n$s is within the expert threshold, and is a "beginner" if the sum is equal to or greater than the beginner threshold.

TABLE 1

| Operation | Expert | Beginner |
|---|---|---|
| (1) Open cover of cup space | 1.5 sec | 5.0 sec |
| (2) Place empty cup | 1.0 sec | 3.5 sec |
| (3) Close cover of cup space | 1.0 sec | 3.0 sec |
| (4) Press drink button | 1.5 sec | 4.0 sec |
| (5) After pouring ends, take out drink | 2.0 sec | 5.0 sec |
| Sum total | 7.0 sec | 20.5 sec |

In addition, in regard to an "expert", the personal identification server 2 may further calculate proficiency from a ratio of an operation time with respect to a threshold, for example.

In addition, an "intermediate" may be defined between a beginner and an expert. For example, determination may be made as follows: the user is a "beginner" if at least one $T_n$ is greater than the beginner threshold, the user is an "expert" if all $T_n$s are within the expert threshold, and the user is an "intermediate" otherwise. In addition, determination may be made as follows: the user is an "expert" if the sum of $T_n$s is within the expert threshold, the user is a "beginner" if the sum is equal to or greater than the beginner threshold, and the user is an "intermediate" otherwise.

Next, in the case where the user has used the coffee server 5 in the past (Yes in step S212) and is an expert (Yes in step S215), the information processing terminal 1-2 generates a UI matching proficiency by the screen generation unit 102, and displays the UI on the display unit 14 by the display control unit 103. Note that the proficiency may be calculated in the information processing terminal 1-2.

On the other hand, in the case where the user has not used the coffee server 5 in the past (No in step S212) or in the case where the user has used the coffee server 5 in the past (Yes in step S212) but is not an expert (No in step S215), the information processing terminal 1-2 generates a UI for beginners by the screen generation unit 102, and displays the UI on the display unit 14 by the display control unit 103.

Figure 15:
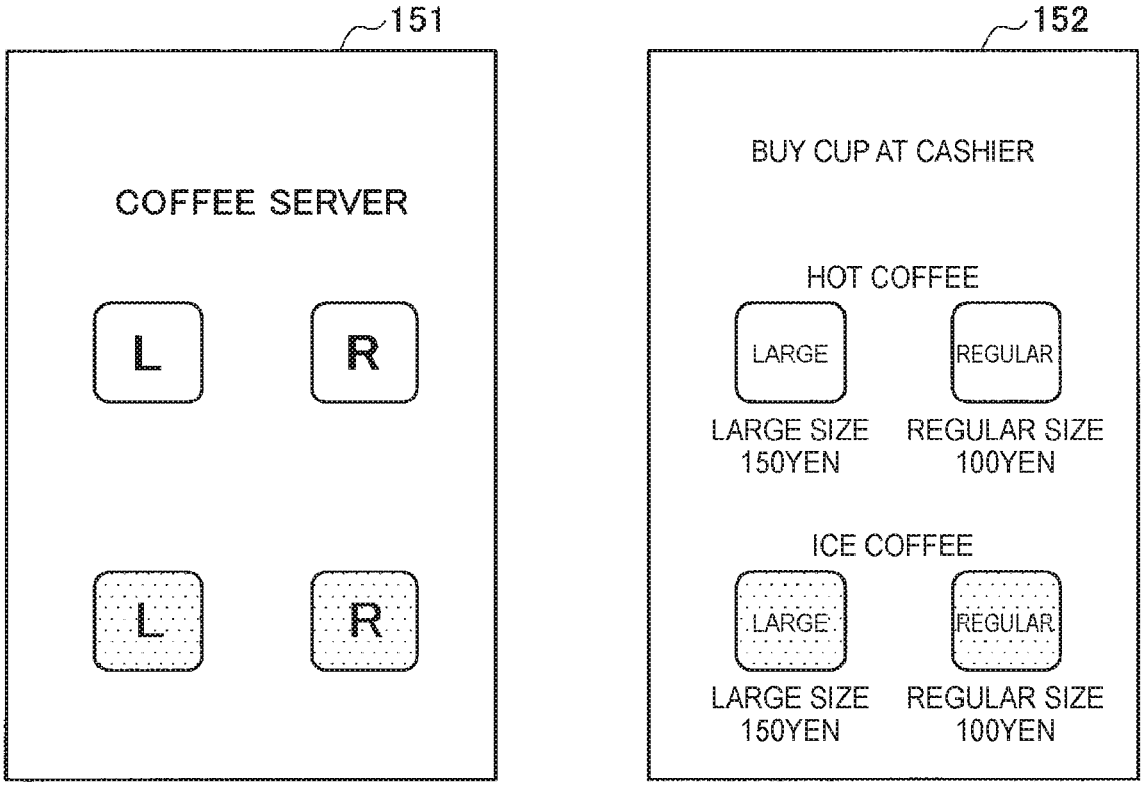
FIG. 15 illustrates examples of UIs for beginners and experts according to the second example.

In this manner, an appropriate operation screen is presented in accordance with the estimated degree of understanding of the user. Here, FIG. 15 illustrates examples of UIs for beginners and experts according to the present example. As illustrated on the left of FIG. 15, as a UI 151 for experts, a UI with high designability and little explanation of operations is assumed. Specifically, a UI that is designed in total with the design of the coffee server 5 by a designer may be used, for example. Thus, designability of the coffee server 5 can be kept without impairing surrounding scenery.

Note that in the case where an "intermediate" is defined as described above, the information processing terminal 1-2 may display a UI for intermediates.

Then, the information processing terminal 1-2 starts measuring an operation time by the timer 18 (step S224).

Specifically, first, the information processing terminal 1-2 sets an operation time threshold $Th_n$ (n is the number of the operation procedure) of the next operation (step S227).

Next, the information processing terminal 1-2 determines whether or not the user has performed a necessary operation (step S230). The user operation may be observed by the camera 12, or is recognized on the basis of an operation input to the touch panel 17, user operation information acquired from the coffee server 5 via the communication unit 11, or the like.

Then, in the case where the necessary operation is not performed (No in step S230) and the operation time of the current operation exceeds the operation time threshold $Th_n$ (Yes in step S233), the information processing terminal 1-2 changes the operation screen to be displayed on the display unit 14 to a UI for beginners (step S236). At this time, an audio guidance about the operation procedure may be output.

Next, in response to the change to the UT for beginners, the operation time threshold $Th_n$ is updated (step S239). For example, the same operation time threshold $Th_n$ may be newly set, or an operation time threshold $Th_n$ for beginners may be set.

Then, steps S227 to S239 are repeated until all necessary operations end, and when all necessary operations end (Yes in step S242), the information processing terminal 1-2 determines whether or not the user is an expert on the basis of the total sum of operation times taken to finish all operations, or the like (step S245).

Then, the information processing terminal 1-2 transmits a determination result to the personal identification server 2 (step S248). Thus, user information accumulated in the personal identification server 2 is updated. Note that information is newly registered in the case of a new user.

The operation processing according to the present example has been specifically described above. Note that in step S245, whether or not the user is an expert may be determined in the personal identification server 2. In this case, the information processing terminal 1-2 transmits measured operation times to the personal identification server 2.

In addition, personal identification is not limited to a method based on a facial image. For example, personal identification can also be performed by using a prepaid card using a noncontact IC card (or a communication terminal such as a smartphone). In addition, information of whether or not the person is an expert (the number of uses, accumulated data of operation times, etc.) can be extracted from the prepaid card without specifying an individual, which eliminates the concern about a violation of privacy.

In addition, the present example can also be made to function without performing personal identification. For example, a standard UI may be displayed first, and the UI may be changed (changed to a UI for beginners or experts) in accordance with time taken for a user operation. Note that further stepwise UIs may be prepared.

In addition, the information processing terminal 1-2 according to the present example may be applied to home electrical appliances. For example, using touch-panel electronic paper as the display unit 14 makes it possible to present a UI matching (the proficiency of) the user. For example, microwave ovens and washing machines, which have many functions, and stereo component systems and humidifiers, whose appearance is important when placed in a living room, and the like originally have a cluttered operation surface due to many buttons and text, and often do not match the interior and colors in the room. Hence, using touch-panel electronic paper (the information processing terminal 1-2) as the operation surface makes it possible to keep scenery inside the room.

«4. Third Example»

Next, a third example is described with reference to FIGS. 16 to 19. The third example describes a case of application to a refrigerator (a storage).

Figure 16:
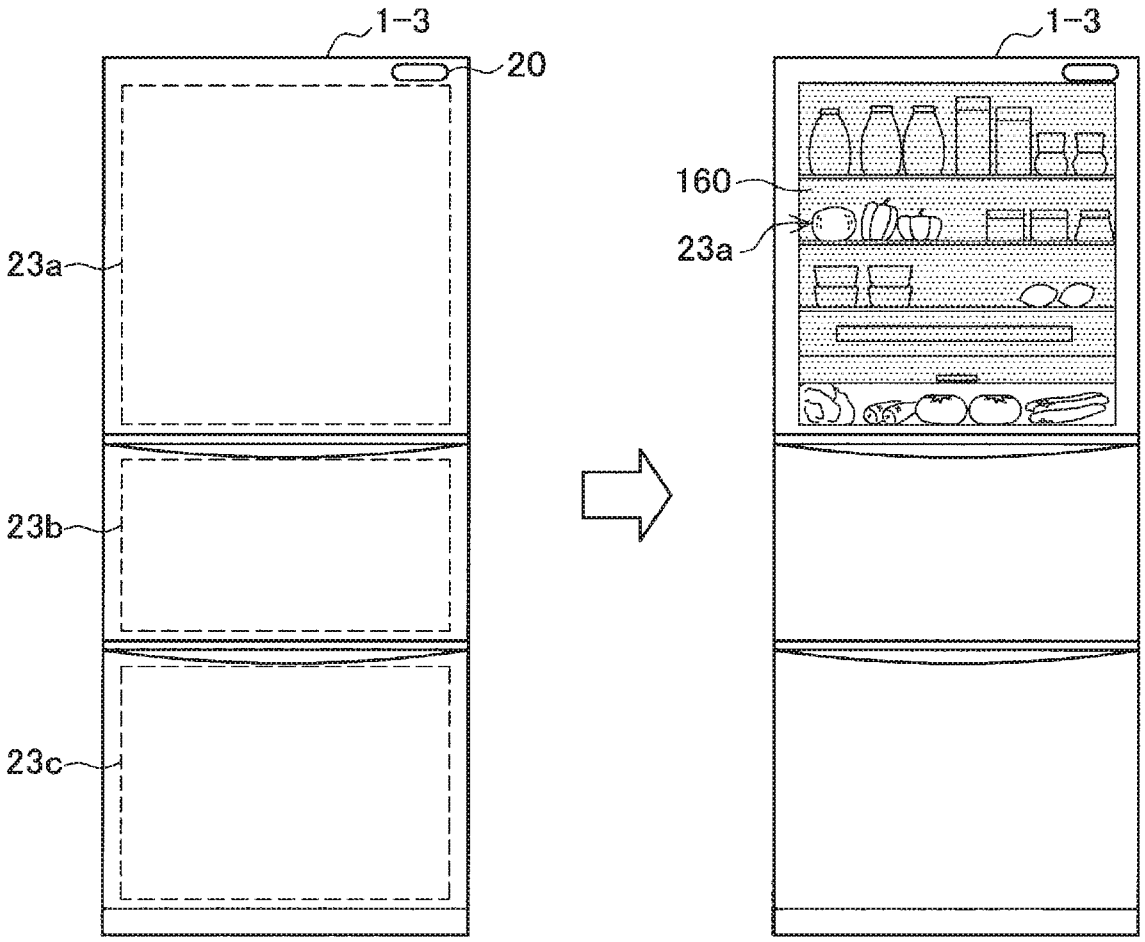
FIG. 16 is a diagram for describing an overview of a third example.

FIG. 16 is a diagram for describing an overview of the present example. As illustrated in FIG. 16, in the present example, door portions of a refrigerator device 1-3 are provided with display units 23 (23*a* to 23*c*) of electronic paper. In addition, the refrigerator device 1-3 is provided with an audio input unit 20 (microphone) that acquires user voice. In addition, the refrigerator device 1-3 is provided with refrigerator interior lighting and a refrigerator interior camera (not illustrated), and can illuminate and image the inside of the refrigerator.

The refrigerator device 1-3 according to the present example normally displays camouflage images reproducing the original color of the refrigerator, such as while or pale blue, on the display units 23*a* to 23*c*. Then, when an audio instruction to check the refrigerator interior is given, a refrigerator interior image 160 obtained by imaging the refrigerator interior is displayed on the display unit 23*a* of the corresponding door in response to the instruction. Thus, a user can check the contents of the refrigerator without opening the door. The refrigerator interior image 160 to be displayed on the display unit 23*a* may be subjected to predetermined image processing. For example, in the example illustrated in FIG. 16, in response to a user instruction such as "show me vegetables", image processing such as expressing food materials of interest in full color and others in black and white in a captured image captured by the refrigerator interior camera is performed; thus, the food materials of interest can be made noticeable.

<4-1. Configuration>

Figure 17:
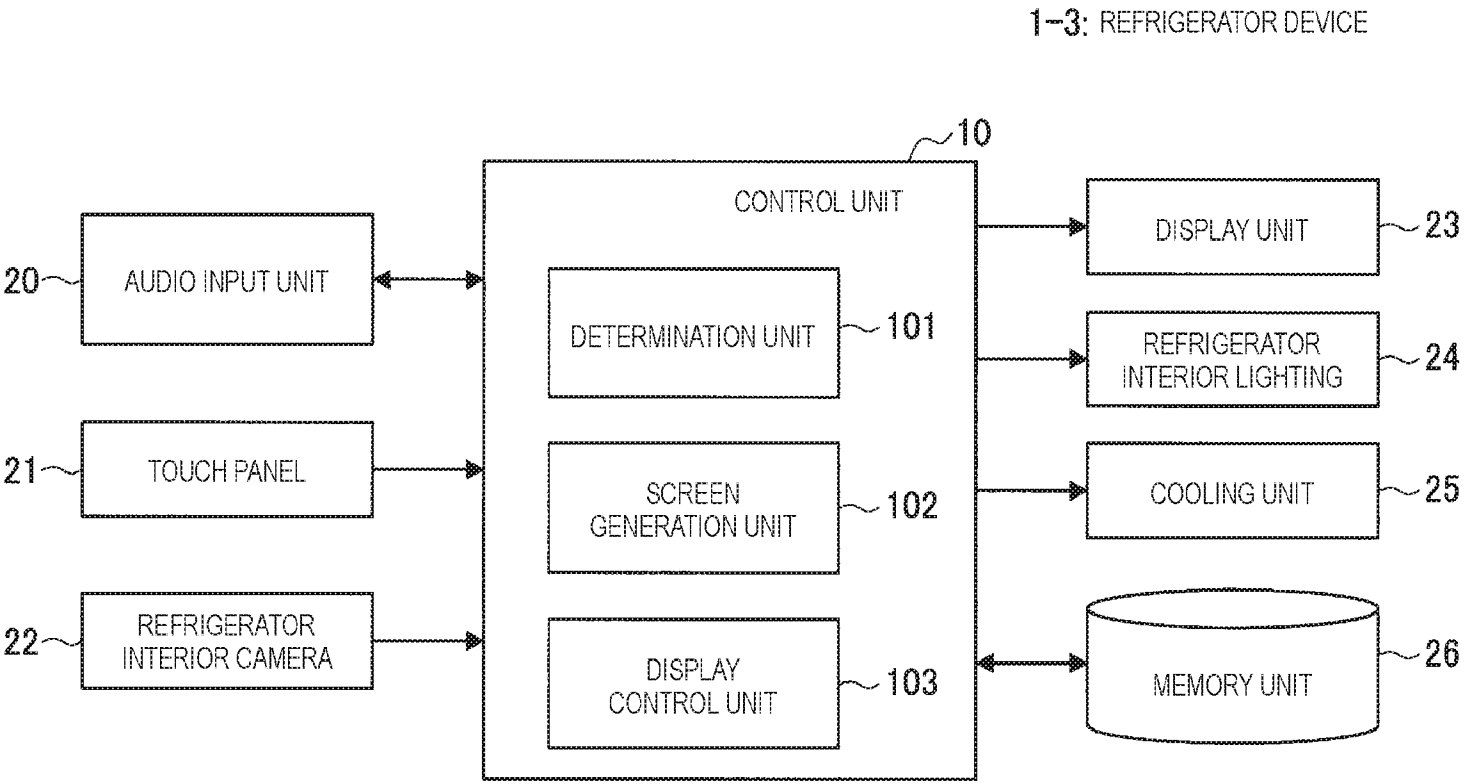
FIG. 17 illustrates an example of a configuration of a refrigerator device according to the third example.

FIG. 17 illustrates an example of a configuration of the refrigerator device 1-3 according to the present example. As illustrated in FIG. 16, the refrigerator device 1-3 includes the control unit 10, the audio input unit 20, a touch panel 21, a refrigerator interior camera 22, the display unit 23, refrigerator interior lighting 24, a cooling unit 25, and a memory unit 26.

The control unit 10 functions as the determination unit 101, the screen generation unit 102, and the display control unit 103. The determination unit 101, the screen generation unit 102, and the display control unit 103 mainly have functions similar to those in the examples described above. That is, the determination unit 101 determines whether or not information presentation is necessary in accordance with a surrounding situation. In addition, in the case where the determination unit 101 determines that information presentation is necessary, the screen generation unit 102 generates an appropriate screen on the basis of a captured image captured by the refrigerator interior camera 22 in response to a user instruction. In addition, the screen generation unit 102 generates a camouflage image that blends into the surroundings in the case where information presentation is unnecessary. Then, the display control unit 103 displays the screen generated by the screen generation unit 102 on the display unit 23.

The audio input unit 20 is implemented by a microphone, a microphone amplifier that performs amplification processing on an audio signal obtained by the microphone, and an A/D converter that performs digital conversion on the audio signal, and outputs the audio signal to the control unit 10. The audio input unit 20 according to the present example collects sound of the user's instruction to check the refrigerator interior, or the like, and outputs it to the control unit 10.

The touch panel 21 is provided in the display unit 23, detects the user's operation input to an operation screen or a refrigerator interior image displayed on the display unit 23, and outputs the operation input to the control unit 10.

The refrigerator interior camera 22 is a camera that images the inside of the refrigerator, and may include a plurality of cameras. In addition, the refrigerator interior camera 22 may be implemented by a wide-angle camera.

Under the control of the display control unit 103, the display unit 23 displays a refrigerator interior image or a camouflage image. In addition, the display unit 23 is implemented by an electronic paper display.

The refrigerator interior lighting 24 has a function of illuminating the refrigerator interior, and may include a plurality of pieces of lighting. It is turned on when imaging is performed with the refrigerator interior camera 22, and is turned on also when a door of the refrigerator device 1-3 is opened.

The cooling unit 25 has the original function of the refrigerator, and is configured to cool the refrigerator interior.

The memory unit 26 is implemented by a read only memory (ROM) that stores a program, an operation parameter and the like to be used for processing by the control unit 10, and a random access memory (RAM) that temporarily stores a parameter and the like varying as appropriate.

<4-2. Operation Processing>

Figure 18:
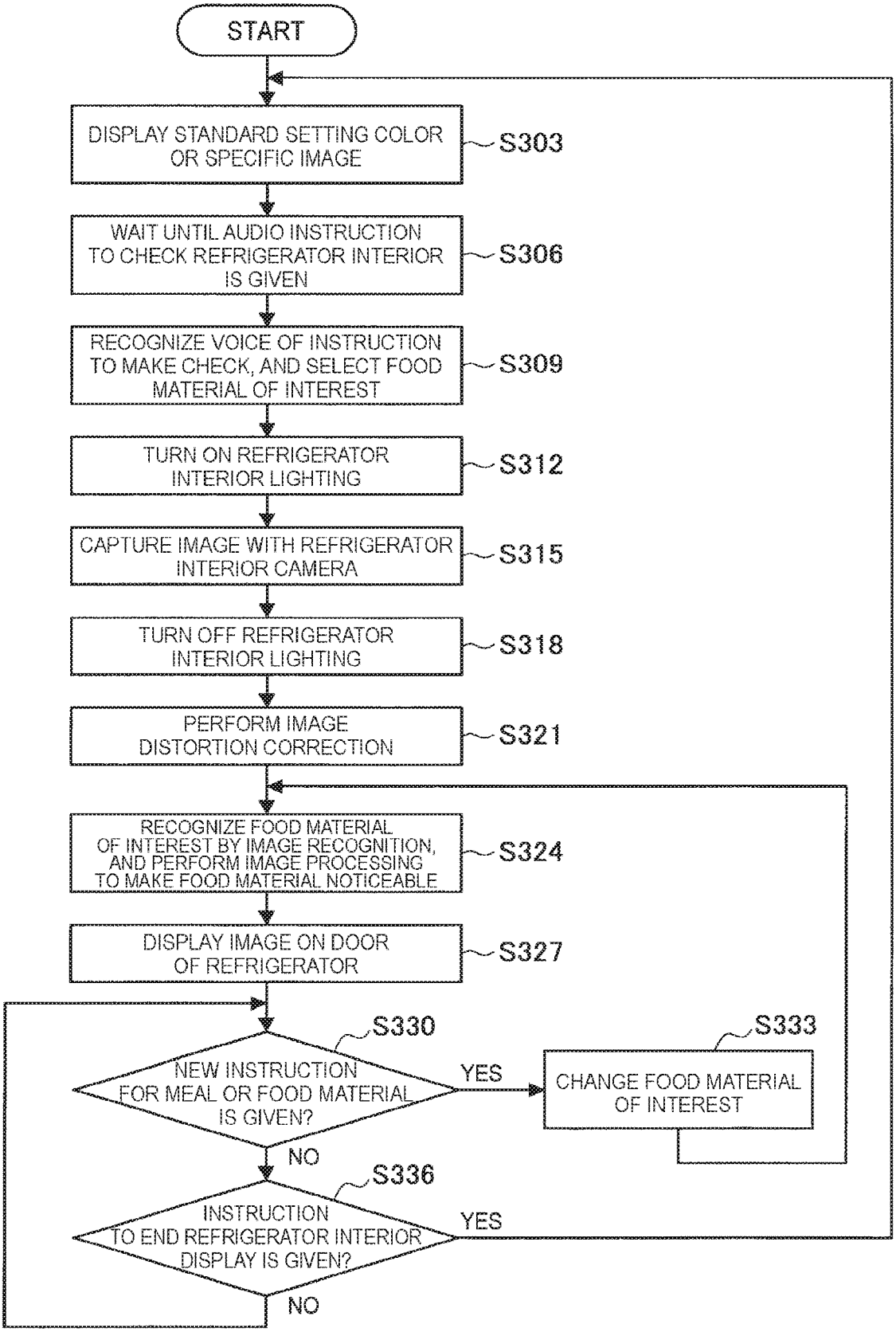
FIG. 18 is a flowchart illustrating operation processing according to the third example.

Next, operation processing according to the present example is described with reference to FIG. 18. FIG. 18 is a flowchart illustrating operation processing according to the present example.

As illustrated in FIG. 18, first, the display control unit 103 of the refrigerator device 1-3 displays, on all the display units 23*a* to 23*c*, the original color of the refrigerator (standard setting color), such as white or pale blue, or a specific image (a camouflage image in either case) (step S303).

Next, the refrigerator device 1-3 waits until an audio instruction to check the refrigerator interior is given (step S306). Note that the instruction to check the refrigerator interior is not limited to voice, and may be performed from an operation button (not illustrated) or an operation button UI displayed on the display unit 23 (detected by a touch panel). However, since hands are wet or dirty during cooking or the like, it is very useful to be able to check the refrigerator interior by an audio instruction without touching the refrigerator. In addition, the refrigerator device 1-3 may be provided with a camera for recognizing a user who stands in the front, and may accept an instruction to check the refrigerator interior after recognizing that the user is a specific user (a resident, a family member, etc.). Alternatively, a specific user may be recognized by voice recognition.

Then, the refrigerator device 1-3 recognizes voice of the instruction to make a check, and selects the food material of interest (step S309). That is, the instruction to check the refrigerator interior can, for example, directly indicate a type of food material like "show me vegetables", or designate a name of meal like "ingredients of ginger-fried pork" or the like; in this case, a target food material is selected by voice recognition. Note that in the case where an instruction of "show me refrigerator interior" is made without designating a food material, selection here is not particularly performed, and a refrigerator interior image is simply displayed.

Next, the refrigerator device 1-3 turns on the refrigerator interior lighting 24 (step S312), images the refrigerator interior with the refrigerator interior camera 22 (step S315), and turns off the refrigerator interior lighting when imaging ends (step S318). Which refrigerator interior camera 22 is used for imaging is selected in accordance with the instruction to check the refrigerator interior. In addition, the refrigerator interior camera 22 may image a vegetable compartment and a freezer compartment from above, for example, so that what the refrigerator interior is like can be grasped well, or may perform imaging from a plurality of sides so that the user can indicate from which angle to see the refrigerator interior. In addition, the inside (storage space) of the door can be imaged, and refrigerator interior images can be switched and displayed.

Then, image distortion correction is performed (step S321). This is because image distortion correction is preferably performed in the case where the refrigerator interior camera 22 is a wide-angle camera. Note that since a lens that is used is known, correction parameters are also known in advance, and correction can be applied using an existing algorithm.

Then, the screen generation unit 102 of the refrigerator device 1-3 specifies a food material of interest by performing image recognition on the refrigerator interior image, and performs processing for making the food material noticeable by image processing (step S324). For example, as in the refrigerator interior image 160 in FIG. 16, where the necessary food material is may be enabled to be grasped at a glance by expressing food materials other than the food material of interest in black and white. In addition, in the case where a food material is not specified in the instruction to check the refrigerator interior (in the case of an instruction to simply check the refrigerator interior), such image processing for making a specific food material noticeable is not performed.

Figure 19:
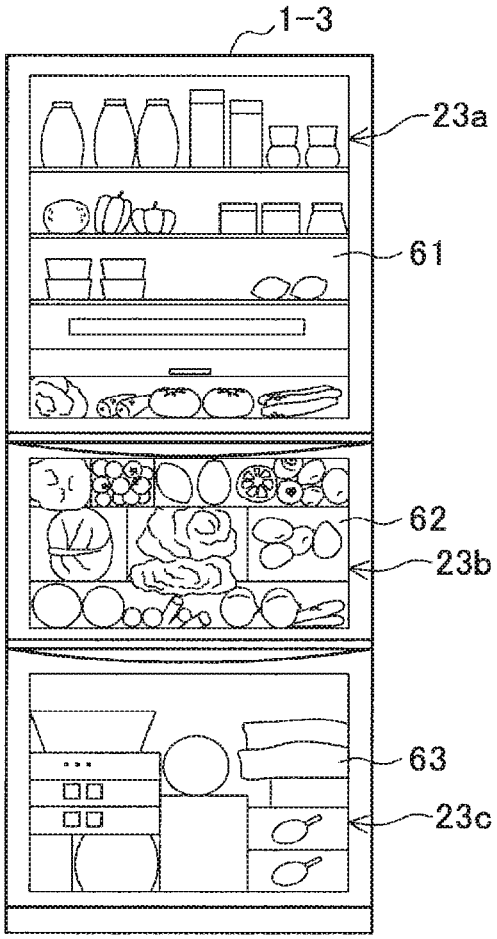
FIG. 19 illustrates an example of refrigerator interior display according to the third example.

Next, the display control unit 103 of the refrigerator device 1-3 displays a refrigerator interior image on the display unit 23 of the door corresponding to the captured refrigerator interior image, among the display units 23*a* to 23*c* provided on respective doors of the refrigerator (step S327). Here, FIG. 19 illustrates a display example in the case where a food material is not specified in the instruction to check the refrigerator interior (in the case of an instruction to simply check the refrigerator interior). As illustrated in FIG. 19, in the case of an instruction to simply check the refrigerator interior, corresponding refrigerator interior images 61 to 63 are displayed on the display units 23*a* to 23*c* provided on the respective doors of the refrigerator device 1-3.

Then, in the case where a new instruction for a meal or food material (instruction to check the refrigerator interior) is input (Yes in step S330), the food material of interest is changed (step S333), and processing returns to step S324.

On the other hand, in the case where an instruction to end refrigerator interior display is given (Yes in step S336), processing returns to step S303, and the standard setting color or a specific image (a camouflage image in either case) is displayed on all the display units 23.

In this manner, according to the present example, a camouflage image can be displayed to prevent scenery from being impaired in normal operation, and if needed, what the refrigerator interior is like can be seen without opening the door. Note that image processing performed on a refrigerator interior image is not limited to image processing for making the food material of interest noticeable as described above. For example, in the case where the user is meeting a guest (a person around the refrigerator is recognized with a camera), display may be performed with some food materials replaced with expensive food materials on purpose.

«5. Fourth Example»

Next, a fourth example is described with reference to FIGS. 20 to 22. The fourth example describes a case of application to guidance display in stairs of a station, or the like.

Figure 20:
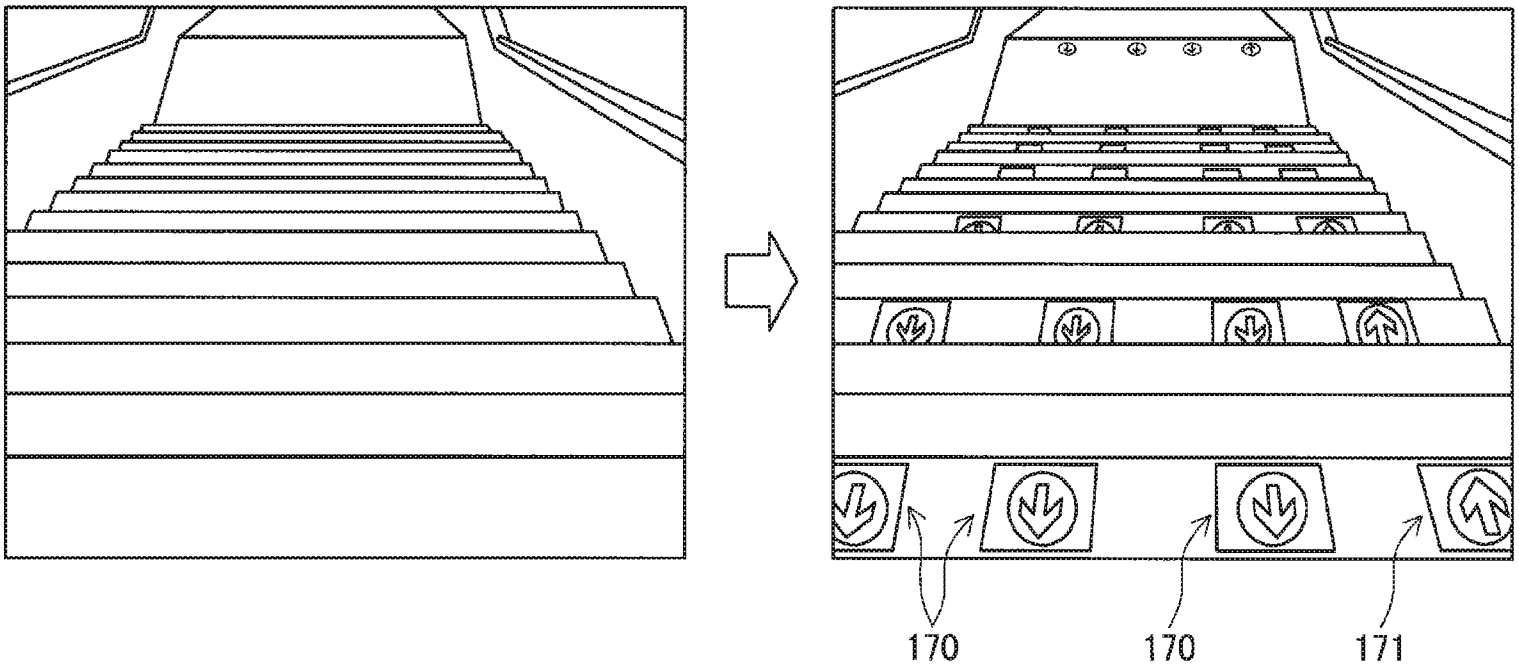
FIG. 20 is a diagram for describing an overview of a fourth example.

FIG. 20 is a diagram for describing an overview of the fourth example. In general, in stairs or passages of stations, guidance display is performed to spare the space of the stairs or passages for the side with more traffic volume, in consideration of people flow in rush hours. However, congestion situations and people flow in stairs or passages of stations fluctuate in accordance with a time slot, train arrival timing, and the like, and a guidance display that is put up cannot always cope with all situations. In addition, even if the exterior and interior of the station is designed by a spatial designer or the like, putting up a large number of such guidance displays, displays for calling users' attention, and the like impairs the intended designability.

Hence, in the present example, in stairs of a station, or the like, for example, guidance display is not performed normally (in non-rush hours), and an image that blends into surrounding scenery is displayed so as not to impair scenery, as illustrated on the left of FIG. 20; in rush hours, appropriate information presentation is performed by displaying guidance displays 170 and 171, as illustrated on the right of FIG. 20.

Whether or not the time is rush hours may be determined on the basis of, for example, a time slot, train arrival timing reported from a train management server 6, or sensor data (traffic volume) of a people flow sensor (not illustrated) installed in the stairs. The people flow sensor can detect traffic volume; furthermore, in the case where people flow sensors are provided in a plurality of places (e.g., an upper part and a lower part of the stairs), people flow (which of people ascending the stairs or people descending the stairs are more than the other) can also be detected in accordance with fluctuation of traffic volume detected by each people flow sensor.

<5-1. Configuration>

Figure 21:
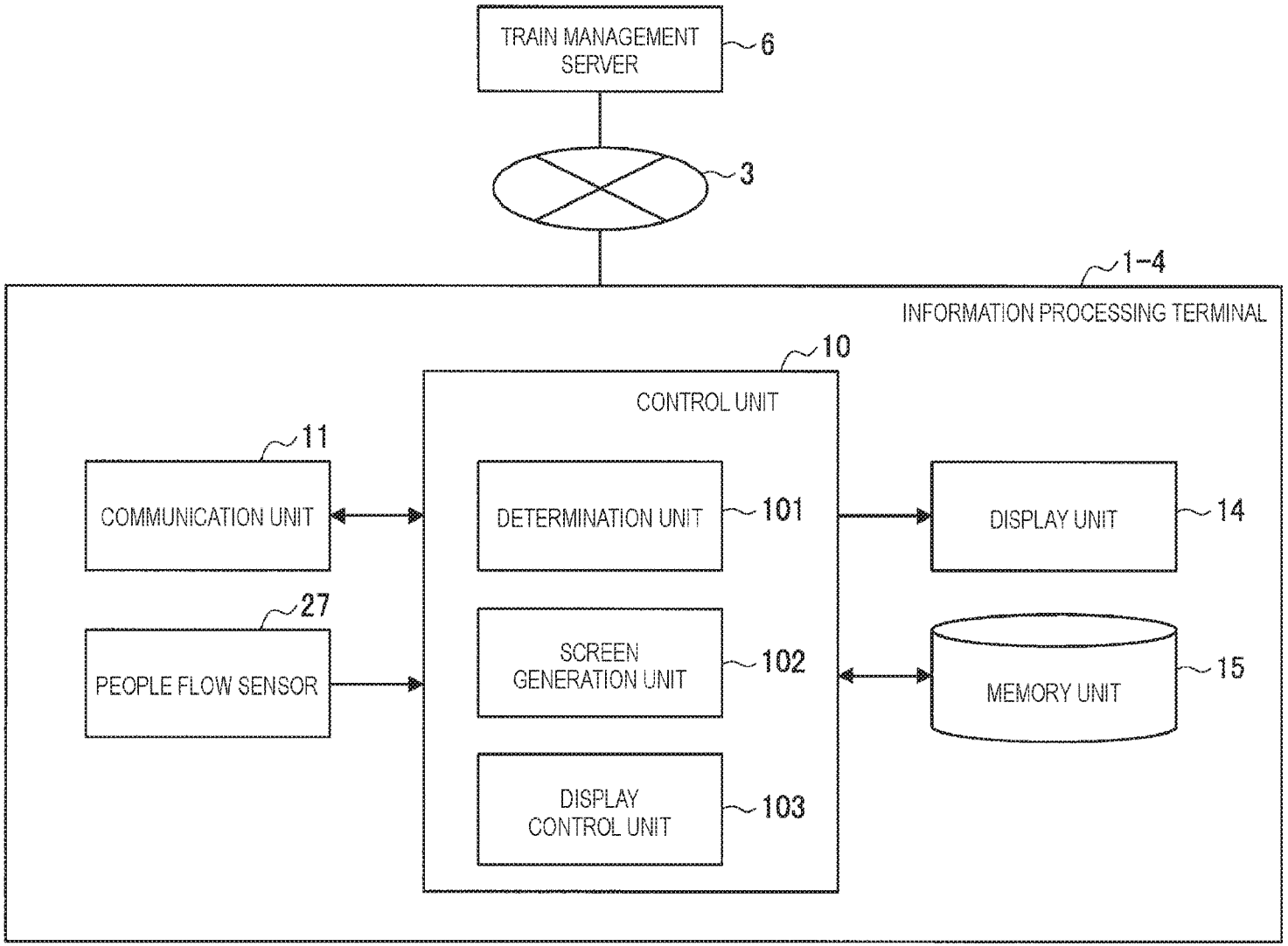
FIG. 21 illustrates an example of a configuration of an information processing system according to the fourth example.

FIG. 21 illustrates an example of an overall configuration of an information processing system according to the present example. As illustrated in FIG. 21, the information processing system according to the present example includes an information processing terminal 1-4 and the train management server 6, and the information processing terminal 1-4 and the train management server 6 are connected via the network 3.

The information processing terminal 1-4 includes the control unit 10, the communication unit 11, the display unit 14, the memory unit 15, and a people flow sensor 27.

The control unit 10 functions as the determination unit 101, the screen generation unit 102, and the display control unit 103. The determination unit 101, the screen generation unit 102, and the display control unit 103 mainly have functions similar to those in the examples described above. That is, the determination unit 101 determines whether or not information presentation is necessary in accordance with a surrounding situation. Specifically, the determination unit 101 determines whether or not to present information such as guidance, in accordance with train arrival timing received by the train management server 6 via the communication unit 11, traffic volume and people flow data detected by the people flow sensor 27, or a time slot.

In addition, in the case where the determination unit 101 determines that information presentation is necessary, the screen generation unit 102 generates an appropriate guidance screen on the basis of the traffic volume and people flow. For example, in the case of congestion due to a large number of ascending users, a guidance display for ascent is generated to be displayed in three lines among four guidance display lines to be displayed on the stairs. On the other hand, for example, in the case of congestion due to a large number of descending users, a guidance display for descent is generated to be displayed in three lines among four guidance display lines to be displayed on the stairs. In addition, the screen generation unit 102 generates a camouflage image that blends into the surroundings in the case where information presentation is unnecessary.

Then, the display control unit 103 displays the screen generated by the screen generation unit 102 on the display unit 14.

The communication unit 11 connects to the network 3 in a wired/wireless manner, and transmits and receives data to and from the train management server 6 on the network.

Under the control of the display control unit 103, the display unit 14 displays a guidance display or a camouflage image. In addition, the display unit 14 is implemented by an electronic paper display, and a plurality of displays are installed on the steps of the stairs as illustrated in FIG. 20.

The memory unit 15 is implemented by a read only memory (ROM) that stores a program, an operation parameter and the like to be used for processing by the control unit 10, and a random access memory (RAM) that temporarily stores a parameter and the like varying as appropriate.

The people flow sensor 27 is a sensor that detects traffic volume, and may be provided in a plurality of places, such as an upper part and a lower part of the stairs. People flow (how much users are moving in which direction) can also be recognized in accordance with a change in traffic volume in the plurality of places. The people flow sensor 27 may be implemented by a pressure sensor, for example, and may detect traffic volume by counting the number of times of being depressed. In addition, the people flow sensor 27 may be implemented by a motion detector or an interruption sensor using infrared rays, and may count the number of people who pass by.

The configuration example of the information processing system according to the present example has been specifically described above.

<5-2. Operation Processing>

Next, operation processing according to the present example is described with reference to FIG. 22. FIG. 22 is a flowchart illustrating operation processing according to the present example.

Figure 22:
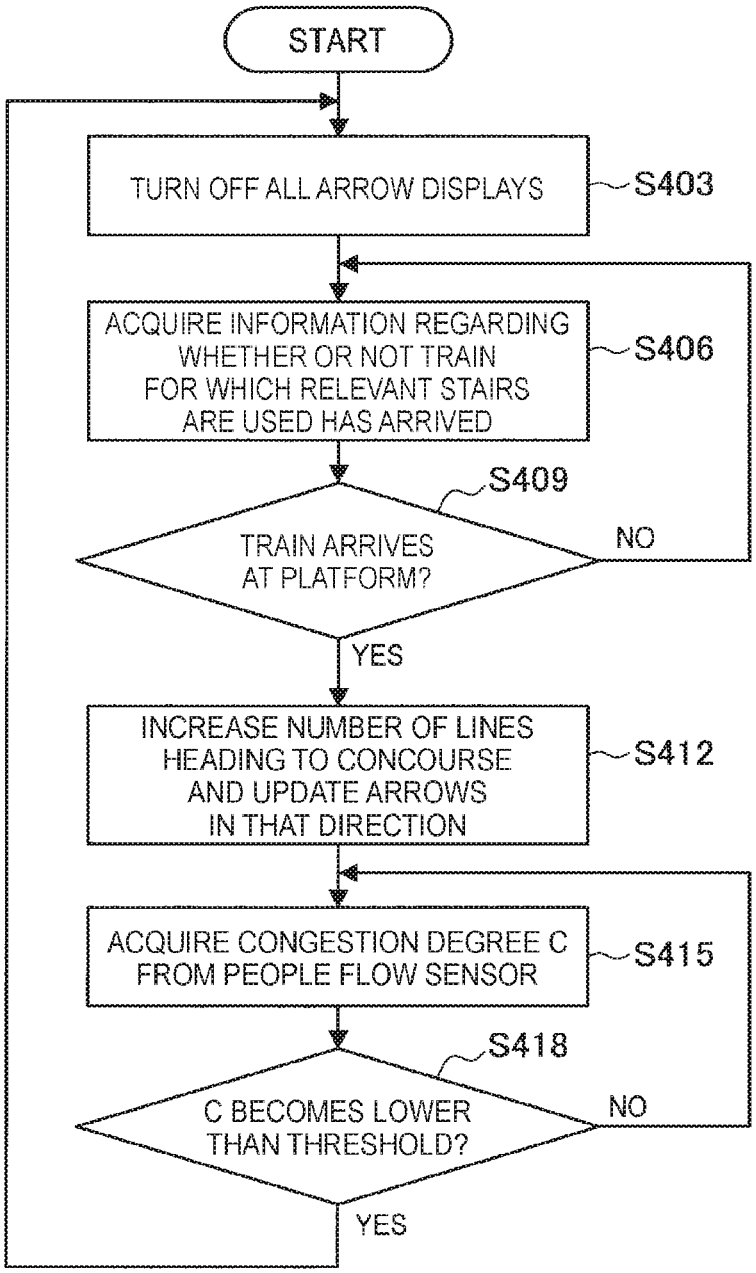
FIG. 22 is a flowchart illustrating operation processing of the fourth example.

As illustrated in FIG. 22, first, the display control unit 103 of the information processing terminal 1-4 turns off all arrow displays (guidance displays) (step S403).

Next, the information processing terminal 1-4 acquires, from the train management server 6, information regarding whether or not a train for which the stairs having the information processing terminal 1-4 installed are used has arrived at a platform (step S406). In the present example, whether or not a train has arrived at the station is managed by another system; hence, the information processing terminal 1-4 acquires train arrival information via the network 3.

Then, when the train arrives at the platform (Yes in step S409), the ascent side (or the descent side) is assumed to become crowded in the stairs leading from the platform of the station to a concourse on the floor above (or below); hence, the information processing terminal 1-4 updates a display screen to increase the number of lines of guidance displays heading to the concourse and make arrows face the direction of the concourse (step S412). For example, display is made asymmetric by using three lines among four lines for ascent guidance and one line for decent guidance; thus, guidance display balance between ascent and descent can be dynamically changed.

Next, the information processing terminal 1-4 acquires a congestion degree C. from the people flow sensor 27 (step S415). For example, in the case where the people flow sensor 27 is installed at upper and lower ends of the stairs, the information processing terminal 1-4 recognizes the number of people who go through the stairs on the basis of data detected by each people flow sensor 27, and calculates the congestion degree C.

Then, in the case where the congestion degree C. becomes lower than a predetermined threshold (Yes in step S418), congestion is estimated to have been solved; hence, the information processing terminal 1-4 returns to step S403, and returns to a state where all arrow displays (guidance displays) are off.

The operation processing according to the present example has been specifically described above. Note that to prevent short-time interruption of people flow from causing guidance displays to return, a value obtained by counting in a certain time range may be integrated, instead of using a sensor value of a moment, as the congestion degree C. acquired in step S415. For example, the congestion degree C. may be calculated by obtaining the count of the total number of people for one minute.

«6. Conclusion»

As described above, the information processing system according to the embodiment of the present disclosure makes it possible to appropriately present necessary information while maintaining scenery.

The preferred embodiment(s) of the present disclosure has/have been described above with reference to the accompanying drawings, whilst the present disclosure is not limited to the above examples. A person skilled in the art may find various alterations and modifications within the scope of the appended claims, and it should be understood that they will naturally come under the technical scope of the present disclosure.

For example, a computer program for causing hardware such as a CPU, ROM, and RAM built in the information processing terminals 1-1, 1-2, and 1-4, the refrigerator device 1-3, or the personal identification server 2 described above to exhibit functions of the information processing terminals 1-1, 1-2, and 1-4, the refrigerator device 1-3, or the personal identification server 2 can also be produced. Furthermore, a computer-readable storage medium in which the computer program is stored is also provided.

In addition, the information processing terminal 1 according to the present embodiment may be applied to architectures such as buildings. For example, even in the case where a situation occurs in which scenery is impaired, such as Mt. Fuji being hidden by a building, scenery can be shown as if the building has disappeared by displaying an image of Mt. Fuji (e.g., a camouflage image such as a captured image captured in real time) on a wall or the like of the building so that Mt. Fuji hidden by the building can be seen. Note that in the case of a large architecture, a problem may occur in that the image looks blending into the surroundings only from one viewpoint; however, by using a system for bidding by time slots, for example, a camouflage image at the time slot may be generated and displayed to match the viewpoint of a person who has won at the highest price. In addition, the image can be made to blend into the surroundings even if the viewpoint changes to some extent, by enabling an optimum camouflage image depending on a viewing angle to be viewed by using a line-of-sight parallax division scheme, such as a parallax barrier scheme or a lenticular scheme.

In addition, main control (determination processing, screen generation processing, and display control processing) is performed on the information processing terminal 1 side in the examples described above, but may at least partly be performed in a server (e.g., the personal identification server 2). In this case, for example, a control unit of the server functions as a determination unit, a screen generation unit, and a display control unit, and performs control to determine whether to present information on the basis of sensor data (a captured image, operation data, audio data, a detection result of a people flow sensor, etc.) received from the information processing terminal 1, generate an appropriate screen, transmit the generated screen to the information processing terminal 1, and display the screen.

Further, the effects described in this specification are merely illustrative or exemplified effects, and are not limitative. That is, with or in the place of the above effects, the technology according to the present disclosure may achieve other effects that are clear to those skilled in the art from the description of this specification.

Additionally, the present technology may also be configured as below.

(1)

An information processing device including:

a communication unit configured to receive sensor data detected by a sensor for grasping a surrounding situation; and a control unit configured to perform control to generate a control signal for displaying an image including appropriate information on a display unit installed around the sensor, in accordance with at least one of an attribute of a user, a situation of the user, or an environment detected from the sensor data, generate a control signal for displaying a blending image that blends into surroundings of the display unit on the display unit in a case where information presentation is determined to be unnecessary, and transmit the control signal to the display unit via the communication unit.

(2)

The information processing device according to (1), in which the control unit specifies appropriate information in accordance with at least one of a person or a living thing accompanying the user or an object owned by the user recognized on the basis of the sensor data.

(3)

The information processing device according to (1), in which the display unit is provided on an electronic apparatus, the sensor data includes operation information for the electronic apparatus, and the control unit performs control to recognize proficiency of the user for the electronic apparatus in accordance with the operation information, and store the user and the proficiency in association in a memory unit, and performs control to, when information presentation is determined to be unnecessary in accordance with the proficiency of the user for the electronic apparatus, generate a control signal for displaying a blending image that blends into an installation surface where the display unit is installed on the display unit, and transmit the control signal to the display unit via the communication unit.

(4)

The information processing device according to (3), in which the control unit recognizes whether or not the user is an expert of the electronic apparatus in accordance with the operation information, and generates a control signal for displaying the blending image if the user is an expert.

(5)

The information processing device according to (1), in which the display unit is installed on a front surface of a storage and is capable of displaying a storage interior image captured by a camera in the storage, and the control unit performs control to generate a control signal for displaying the storage interior image on the display unit when a specific user is recognized on the basis of the sensor data, generate a control signal for displaying a blending image that blends into surroundings of the display unit on the display unit when a specific user is not recognized, and transmit the generated control signal to the display unit via the communication unit.

(6)

The information processing device according to (5), in which the control unit recognizes the specific user on the basis of user speech voice data that gives an instruction to check an inside of the storage.

(7)

The information processing device according to (6), in which the control unit performs predetermined processing on a storage interior image captured by the camera in the storage in response to the instruction given by the user, and then generates a control signal for displaying the storage interior image.

(8)

The information processing device according to (1), in which the display unit is installed on a passage, and the control unit performs control to generate a control signal for displaying an image including appropriate guidance information on the display unit, in accordance with the number of users detected from the sensor data, generate a control signal for displaying a blending image that blends into the passage where the display unit is installed on the display unit when presentation of guidance information is determined to be unnecessary, and transmit the generated control signal to the display unit via the communication unit.

(9)

An information processing method including, by a processor:

receiving, via a communication unit, sensor data detected by a sensor for grasping a surrounding situation; and performing control to generate a control signal for displaying an image including appropriate information on a display unit installed around the sensor, in accordance with at least one of an attribute of a user, a situation of the user, or an environment detected from the sensor data, generate a control signal for displaying a blending image that blends into surroundings of the display unit on the display unit in a case where information presentation is determined to be unnecessary, and transmit the control signal to the display unit via the communication unit.

(10)

A recording medium having a program recorded thereon, the program causing a computer to function as:

a communication unit configured to receive sensor data detected by a sensor for grasping a surrounding situation; and a control unit configured to perform control to generate a control signal for displaying an image including appropriate information on a display unit installed around the sensor, in accordance with at least one of an attribute of a user, a situation of the user, or an environment detected from the sensor data, generate a control signal for displaying a blending image that blends into surroundings of the display unit on the display unit in a case where information presentation is determined to be unnecessary, and transmit the control signal to the display unit via the communication unit.

REFERENCE SIGNS LIST

1 (1-1, 1-2, 1-4) information processing terminal
1-3 refrigerator device (information processing terminal)
2 personal identification server
3 network
5 coffee server
6 train management server
10 control unit
11 communication unit
12 camera
13 audio output unit
14 display unit
15 memory unit
16 storage medium I/F
17 touch panel
18 timer
20 audio input unit
21 touch panel
22 refrigerator interior camera
23 display unit
24 refrigerator interior lighting
25 cooling unit
26 memory unit
27 people flow sensor
101 determination unit
102 screen generation unit
103 display control unit

The invention claimed is:

1. An information processing device comprising:

circuitry configured to receive sensor data detected by a sensor for capturing an area surrounding the sensor; and generate a control signal for displaying an image including instructional information on a display installed around the sensor, in accordance with a determined user proficiency of a user in using an electronic apparatus associated with the information processing device, generate a control signal for displaying, on the display, a blending image that gives the display an appearance of surfaces surrounding the display in a case where information presentation is determined to be unnecessary based on the determined user proficiency, and transmit the control signal to the display, wherein the circuitry performs control to recognize the determined user proficiency in using the electronic apparatus in accordance with operation information included in the sensor data, and to store the determined user proficiency in association with a corresponding user in a memory.

2. The information processing device according to claim 1, wherein the circuitry specifies the instructional information in accordance with at least one of a person or a living thing accompanying the user or an object owned by the user recognized on a basis of the sensor data.

3. The information processing device according to claim 1, wherein the display is provided on the electronic apparatus, and the circuitry:

performs control to, when information presentation is determined to be unnecessary in accordance with the determined proficiency of the user for the electronic apparatus, generate a control signal for displaying the blending image, and transmit the control signal to the display via the communication.

4. The information processing device according to claim 3, wherein the circuitry recognizes whether or not the user is an expert of the electronic apparatus in accordance with the operation information, and generates a control signal for displaying the blending image if the user is an expert.

5. The information processing device according to claim 1, wherein the display is installed on a front surface of a storage and is configured to display a storage interior image captured by a camera in the storage, and the circuitry is configured to generate a control signal for displaying the storage interior image on the display when a specific user is recognized on a basis of the sensor data, generate a control signal for displaying the blending image on the display when a specific user is not recognized, and transmit the generated control signal to the display.

6. The information processing device according to claim 5, wherein the circuitry recognizes the specific user on a basis of user speech voice data that gives an instruction to check an inside of the storage.

7. The information processing device according to claim 6, wherein the circuitry performs predetermined processing on a storage interior image captured by the camera in the storage in response to the instruction given by the user, and then generates a control signal for displaying the storage interior image.

8. The information processing device according to claim 1, wherein the display is installed on a passage, and the circuitry is configured to generate a control signal for displaying an image including instructional guidance information on the display, in accordance with a number of users detected from the sensor data, generate a control signal for displaying the blending image on the display when presentation of guidance information is determined to be unnecessary, and transmit the generated control signal to the display.

9. An information processing method comprising:

receiving, via circuitry, sensor data detected by a sensor for capturing an area surrounding the sensor;

generating, by the circuitry, a control signal for displaying an image including instructional information on a display installed around the sensor, in accordance with a determined user proficiency of a user in using an electronic apparatus associated with the information processing device;

generating, by the circuitry, a control signal for displaying, on the display, a blending image gives the display an appearance of surfaces surrounding the display in a case where information presentation is determined to be unnecessary based on the determined user proficiency; and transmitting, by the circuitry, the control signal to the display, wherein the determined user proficiency in using the electronic apparatus is recognized in accordance with operation information included in the sensor data, and the determined user proficiency is stored in association with a corresponding user in a memory.

10. A non-transitory computer-readable medium encoded with computer-readable instructions that, when executed by circuitry, cause the circuitry to perform a method comprising:

receiving sensor data detected by a sensor for capturing an area surrounding the sensor;

generating a control signal for displaying an image including instructional information on a display installed around the sensor, in accordance with a determined user proficiency of a user in using an electronic apparatus associated with the information processing device;

generating a control signal for displaying, on the display, a blending image that gives the display an appearance of surfaces surrounding the display in a case where information presentation is determined to be unnecessary based on the determined user proficiency; and transmitting the control signal to the display, wherein the determined user proficiency in using the electronic apparatus is recognized in accordance with operation information included in the sensor data, and the determined user proficiency is stored in association with a corresponding user in a memory.

* * * * *